US008042728B2

(12) United States Patent
Braoudakis

(10) Patent No.: US 8,042,728 B2
(45) Date of Patent: Oct. 25, 2011

(54) PIZZA BOX WITH REMOVABLE PORTIONS USED AS REWARD TOKENS

(75) Inventor: George Braoudakis, Templestowe (AU)

(73) Assignee: Initiatives and Innovations Pty Ltd, Clifton Hill, Victoria (AU)

( * ) Notice: Subject to any disclaimer, the term of this patent is extended or adjusted under 35 U.S.C. 154(b) by 368 days.

(21) Appl. No.: 10/511,177

(22) PCT Filed: Apr. 17, 2003

(86) PCT No.: PCT/AU03/00462

§ 371 (c)(1),
(2), (4) Date: Oct. 14, 2004

(87) PCT Pub. No.: WO03/089315

PCT Pub. Date: Oct. 30, 2003

(65) Prior Publication Data

US 2005/0218202 A1 Oct. 6, 2005

(30) Foreign Application Priority Data

Apr. 17, 2002 (AU) ..... PS 1798

(51) Int. Cl.
*B65D 5/00* (2006.01)

(52) U.S. Cl. ..... 229/178; 206/831; 229/902; 229/915

(58) Field of Classification Search ..... 229/165, 229/175, 120.32, 112, 125.19, 178, 902, 229/906, 916, 919; 206/831
See application file for complete search history.

(56) References Cited

U.S. PATENT DOCUMENTS

| | | | | |
|---|---|---|---|---|
| 2,914,235 | A * | 11/1959 | Jones | 206/511 |
| 2,965,279 | A * | 12/1960 | Campbell | 206/509 |
| 3,804,323 | A | 4/1974 | Bemel | |
| 4,108,350 | A | 8/1978 | Forbes, Jr. | |
| 4,345,393 | A * | 8/1982 | Price et al. | 40/312 |
| 4,648,548 | A * | 3/1987 | Shin | 229/116.4 |
| 5,035,515 | A | 7/1991 | Crossman et al. | |
| 5,072,877 | A | 12/1991 | Van Fulpen | |
| 5,074,462 | A | 12/1991 | Countee, Jr. | |
| 5,236,084 | A * | 8/1993 | Evers | 206/273 |
| 5,385,292 | A * | 1/1995 | Labianca et al. | 229/120 |
| 5,465,837 | A | 11/1995 | Focke | |
| 5,725,146 | A * | 3/1998 | Luberto | 229/120 |
| 5,934,549 | A | 8/1999 | Baumgartner et al. | |
| 5,961,035 | A | 10/1999 | Correll | |

(Continued)

FOREIGN PATENT DOCUMENTS

| | | |
|---|---|---|
| AU | 36854/97 | 2/1998 |

(Continued)

*Primary Examiner* — Nathan J Newhouse
*Assistant Examiner* — Christopher Demeree
(74) *Attorney, Agent, or Firm* — Volpe and Koenig, P.C.

(57) ABSTRACT

A container such as a pizza box having one or more removable portions (46), which can be removed without substantially affecting the enclosing and/or strength properties of the container. The container blank has a central bottom panel (41) with at least one roll over side wall formed of an outer wall panel (48) with removable portions and an inner wall panel (49) that doubles over the outer wall portion to engage extension panels or tabs (8) of adjacent side walls, and has a hinged top panel lid (40). The removable portions (46) may be used for printing promotional material or as reward tokens offering special consideration for future purchases. The container also aims to provide a method of promoting products by way of a container having one or more removable portions and/or to provide a method of subsidizing the cost of the container.

15 Claims, 17 Drawing Sheets

U.S. PATENT DOCUMENTS

| | | | | | |
|---|---|---|---|---|---|
| 5,967,407 | A | * | 10/1999 | Mueller | 229/125.19 |
| 6,027,018 | A | | 2/2000 | Yocum | |
| 6,041,997 | A | * | 3/2000 | Jensen | 229/114 |
| 6,068,181 | A | * | 5/2000 | Cai | 229/116.1 |
| 6,153,280 | A | * | 11/2000 | Uffmann | 428/43 |
| 2001/0010132 | A1 | | 8/2001 | Deuerling | |

FOREIGN PATENT DOCUMENTS

| | | |
|---|---|---|
| DE | 200 06 811 | 8/2000 |
| DE | 20011513 | 12/2000 |
| GB | 2262508 | 6/1992 |
| JP | 10-338224 | 12/1998 |

* cited by examiner

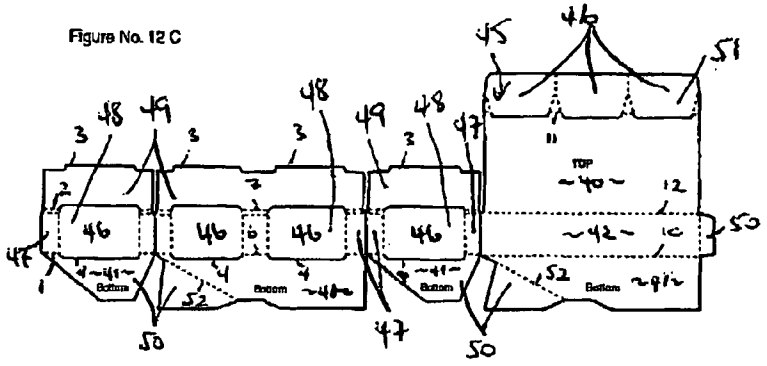
Figure No. 12 C
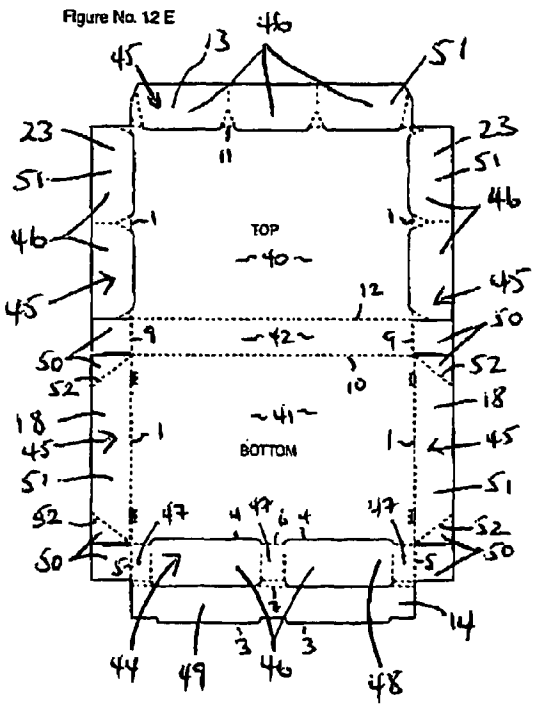
Figure No. 12 E
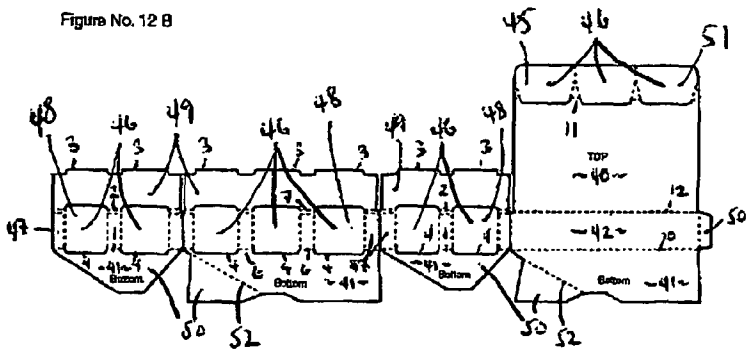
Figure No. 12 B
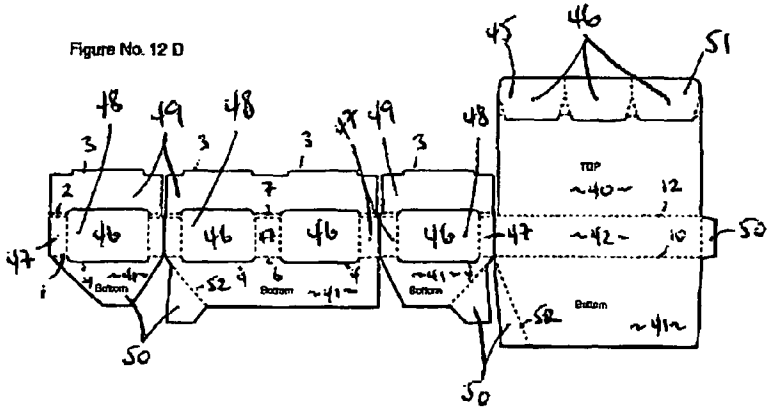
Figure No. 12 D Figure No. 12 F
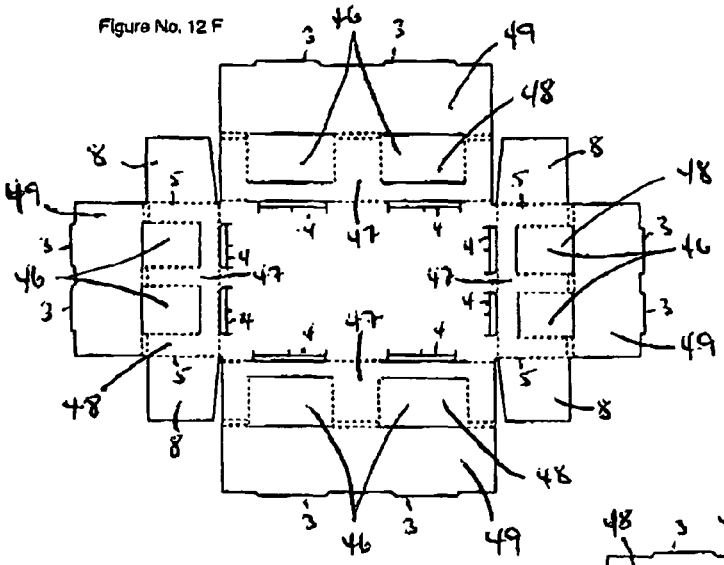
Figure No. 12 G
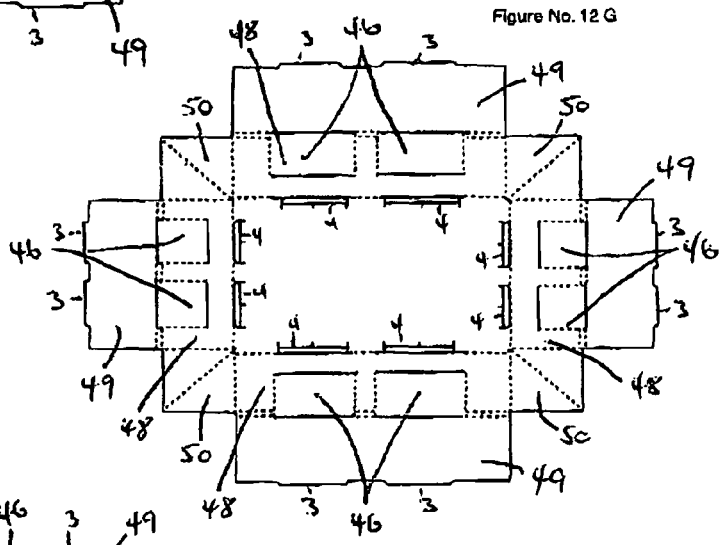
Figure No. 12 H
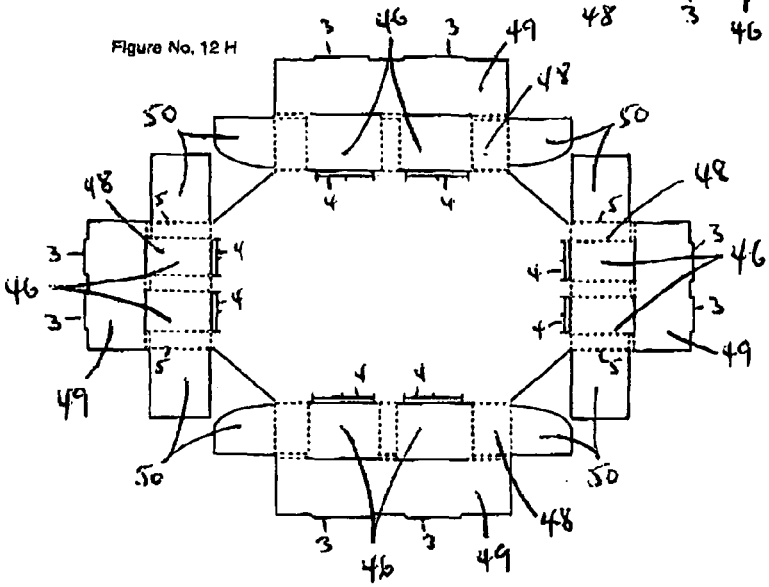

Figure No. 12 I
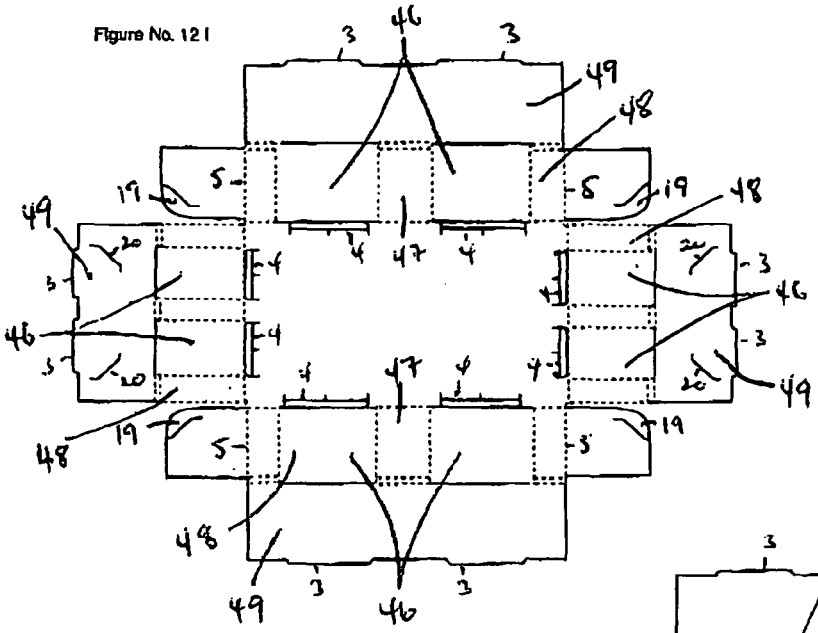
Figure No. 12 J
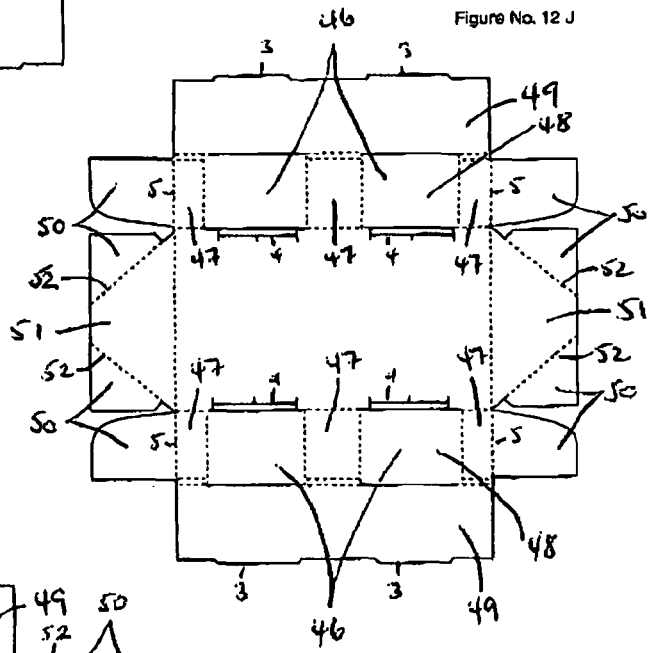
Figure No. 12 K
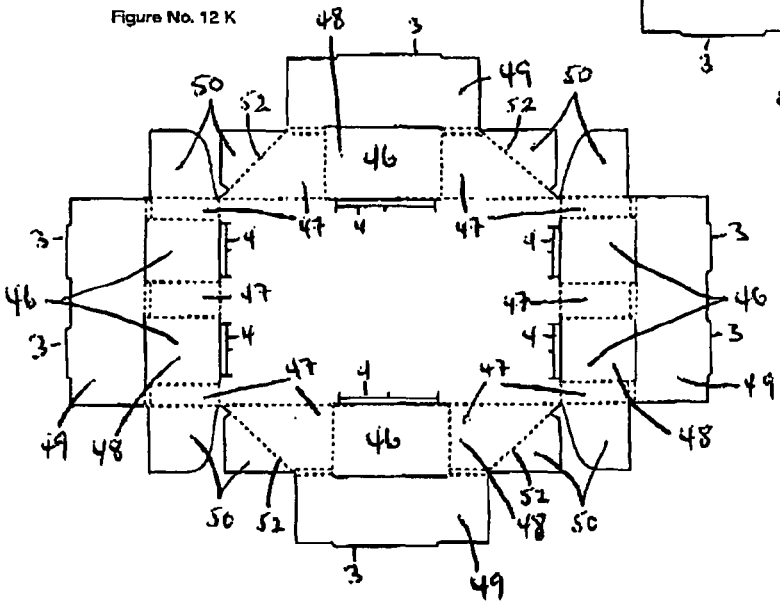

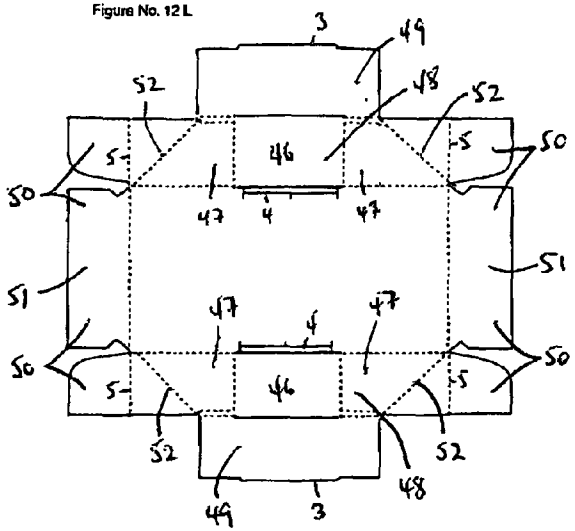
Figure No. 12 L
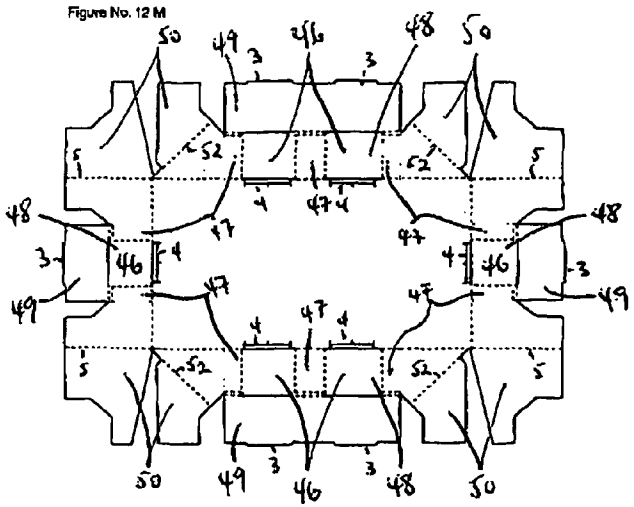
Figure No. 12 M
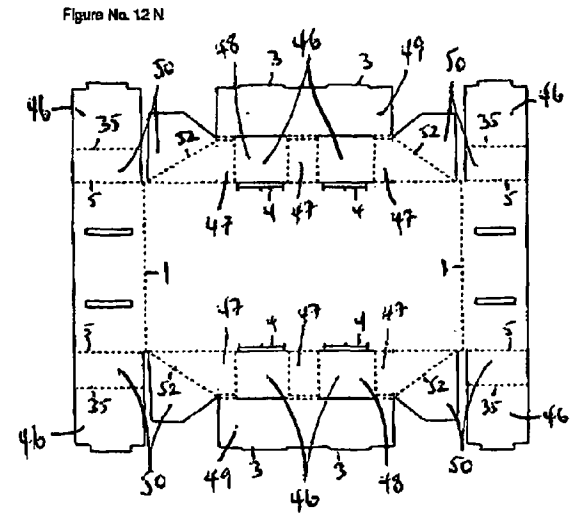
Figure No. 12 N
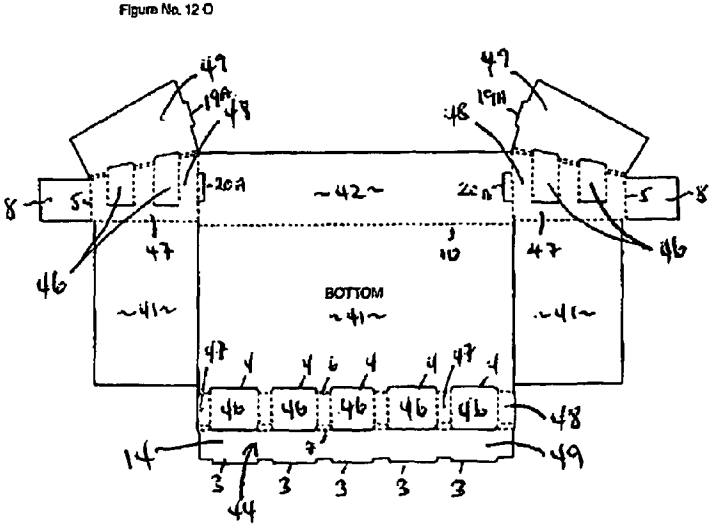
Figure No. 12 O

PIZZA BOX WITH REMOVABLE PORTIONS USED AS REWARD TOKENS

FIELD OF INVENTION

This invention relates to a container with one or more removable portions and having particular application to packaging freshly prepared pizza style pies. However, it will be appreciated that the invention is not necessarily limited to this field of use. Indeed, in this specification examples are given of other containers to which the invention has been applied.

BACKGROUND

Freshly prepared pizza style pies are frequently packaged in cardboard containers or cartons, referred to as "pizza boxes", to maintain freshness and temperature. Pizza boxes are often formed by folding a single sheet of paperboard or cardboard to form a square base panel, four wall panels standing upright therefrom to a relatively uniform height and a lid hinged to the upper edge of one of the wall panels. Usually the lid includes flaps extending from the three edges of a cover panel other than the edge with the hinge connection such that the lid may be pivoted about its hinged connection to the remaining wall panel to close a rectilinear space within the container and pivoted open to gain access to the contents of the pizza box. The flaps about the lid are usually arranged to fit inside the three walls when the pizza box is in its closed disposition.

Pizza boxes often have ventilation holes, the cardboard sheet from which one is formed nearly always being scored and slit at appropriate locations so that when it is folded up to form the pizza box, the parts lock together to prevent "unfolding" of the pizza box. Typically, the side walls of the pizza box are formed as "roll-over" walls formed by having an outer wall panel extending from the edge of a base panel, and an inner wall panel extending from a wall top edge of the outer wall panel remote from the base panel, the relative widths of the outer and inner wall panels being such that the distal edge of the inner wall panel engages with the base panel at or near to a fold line along which the outer wall panel may be folded with respect to the base panel when the inner wall panel is folded with respect to the outer wall panel along the wall top edge until it is substantially alongside the outer wall panel. In this specification, the term "roll-over" walls refers to this and similar arrangements.

Additionally, even though pizza boxes are formed from single cardboard "blanks", the panels forming the boxes being joined along fold or score lines which are constituted by a weakening of the material, the term "edge" is used in this specification to refer to the join line between two adjoining panels even though the panel may be contiguous with one another.

Many pizza restaurants promote their wares not only on the pizza boxes themselves, but also with pamphlets, brochures, flyers and the like, sometimes by letterbox drops, and sometimes with the product sold from their restaurants or delivered to purchasers. Pizza boxes also represent one of the major overheads for pizza restaurants, and it could be advantageous if the cost of the boxes could be offset.

SUMMARY

The present invention aims to provide a container, such as a pizza box as a non-limiting example, having one or more removable portions, which may be removed without substantially affecting the enclosing and/or strength properties of the container. In particular, the removable portions may be used for printing promotional material, or more particularly, the removable portions may be used as reward tokens offering special consideration for future purchases. The invention also aims to provide a method of promoting products by way of a container having one or more removable portions and/or to provide a method of subsidizing the cost of a container. Other aims and advantages of the invention may become apparent from the following description.

With the foregoing in view this invention in one aspect resides broadly in a container including:

a main panel having a plurality of substantially straight edges about its periphery, each edge extending angularly from each of two adjoining edges;

a plurality of side walls depending from at least half of the edges of said main panel, said edges having sidewalls hereinafter referred to as remaining edges;

wherein one or more of said side walls includes an outer wall panel and an inner wall panel, said outer wall panel extending from a proximal fold or score line along a remaining edge and said inner wall panel extending from a distal fold or score line remote from the proximal fold or score line and along an opposed edge of said outer wall panel, the combination of panels forming a roll-over wall; and wherein one or more of said roll-over walls further include one or more removable portions operatively removable to leave a remaining wall portion such that the enclosing and/or strength properties of the container remain substantially unaffected upon removal of any one or more of said removable portions.

In a preferment, the invention provides a container including:

two main panels, each substantially the same shape and having a plurality of substantially straight edges about its periphery, each edge extending angularly from each of two adjoining edges, and said main panels being joined to one another by a joining panel having substantially parallel edges each of which constitutes a hinge line along one of the edges of each said main panel;

a plurality of side walls depending from at least half of the edges of said main panels other than those in common with the hinge line, said edges having sidewalls hereinafter referred to as remaining edges, said side walls and said joining panel enclosing a space between said main panels when said main panels are pivoted towards one another to define the enclosed space;

wherein one or more of said side walls includes an outer wall panel and an inner wall panel, said outer wall panel extending from a proximal fold or score line along a remaining edge and said inner wall panel extending from a distal fold or score line remote from the proximal fold or score line and along an opposed edge of said outer wall panel, the combination of panels forming a roll-over wall; and wherein one or more of said roll-over walls further include one or more removable portions operatively removable to leave a remaining wall portion such that the enclosing and/or strength properties of the container remain substantially unaffected upon removal of any one or more of said removable portions.

Although the removable portions may be provided on or as part of the inner wall panel or the outer wall panel, it is preferred that the removable portions be provided on the outer wall panel whereby removal of the removable portions from the remainder of the outer wall panel leaves the remainder of the outer wall panel and the entire inner wall panel to provide the structural integrity of the container once the one or more of the removable portions have been removed.

In a preferred form, one of the main panels constitutes a base panel and the other a cover panel, and it is preferred that all of the remaining sidewalls of one of the main panels be provided with the sidewalls described above. Suitably, the removable portion or portions are arranged-with a perforation line or line of weakness to facilitate removal from the remaining wall portion and inner wall panel. The remaining outer wall portion together with the inner wall panel (which is preferably left intact after removal of the removable portion) retain sufficient structural integrity that the container remains stackable and performing its function in retaining the heat and/or freshness of its contents when enclosed therein.

Preferably the removable portion and/or the remaining wall portion include a slit or slot providing for a tab or the like to facilitate easy removal of the removable portion from the outer wall panel. If the tabs or the like are provided on the lower surface or edge of the container, they can serve the added purpose of allowing the assembled container to sit off a surface (such as the top of an oven) to allow for the circulation of air. Thus, if a container is placed on top of an oven to keep the enclosed contents warm, the container will not become soggy with moisture. It is also preferred that the removable portions be provided on the outer wall panel of the roll-over wall.

In a preferred form, the removable portions are provided with markings indicating that they constitute an advertising promotion, offer, coupon or token for a reward, such as a discount on further sales, preferably subject to predetermined conditions being met. Of course, the remainder of the container may be provided with markings such as promotional material as desired. The inner wall panel may also be arranged with markings, which become revealed upon removal of a removable portion from the outer wall panel. The offer, coupon or token for a reward may also be provided in the form of promotional advertising, discounts, prizes, special offers or the like from suppliers other than the supplier of the product contained in the container, and may be printed or pre-printed on the offer, coupon or token, or provided in the form of an adhesive label or sticker and any other like form of marking.

Preferably, the sidewalls are at equal angles to each adjoining sidewall (or joining panel, as the case may be). In a preferred form, the side walls have substantially parallel edges such that the main panels are close to a substantially parallel spaced apart disposition, there being preferably three side walls which together with the joining panel constitute a four-sided carton forming a square or rectangular prism. The side walls and joining panel preferably have dimensions selected for the packaging of pizza style pies, and may include ventilation holes, corner reinforcing tabs, simple single-paneled side walls on the main panel not having the roll-over walls and such like as desired.

The removable portion may be provided with magnetic material to permit the removable portion to be temporarily attached to a metallic surface. For example, the ferromagnetic metal of typical white goods, such as refrigerators, may be used as temporary storage and/or display for the removable portions in this form.

In another aspect, this invention resides broadly in a container including:

two main panels, each substantially the same shape and having a plurality of substantially straight edges about its periphery, each edge extending angularly from each of two adjoining edges, and said main panels being joined to one another by a joining panel having substantially parallel edges each of which constitutes a hinge line along one of the edges of each said main panel;

a plurality of side walls depending from at least half of the edges of said main panels other than those in common with the hinge line, hereinafter referred to as remaining edges, said side walls and said joining panel enclosing a space between said main panels when said main panels are pivoted towards one another to define the enclosed space;

wherein one or more of said side walls includes an outer wall panel and an inner wall panel, said outer wall panel extending from a proximal fold or score line along a remaining edge and said inner wall panel extending from a distal fold or score line remote from the proximal fold or score line and along an opposed edge of said outer wall panel to form a roll-over wall; and wherein one or more of said inner wall panels further include a lateral extension extending beyond the distal fold or score line to an end, each lateral extension separated from its associated inner wall panel by a transverse fold line and having a further fold line intermediate the transverse fold line and the end whereby upon folding of the container, the lateral extensions may be folded to form a chamber adjacent the corner between the roll-over wall or walls having the lateral extension and its or their adjoining side wall or walls.

In another aspect, this invention resides broadly in a blank for a carton including:

two main panels, each main panel being substantially the same shape and having a plurality of substantially straight edges or fold or score lines about its periphery, each edge, fold or score line extending angularly to each of two adjoining edges or fold or score lines, and said main panels being joined to one another by a joining panel having substantially parallel edges each of which constitutes a hinge line in common with one of the fold or score lines of each main panel;

a plurality of side panel assemblies extending from the remaining fold or score lines about said main panels such that at least half of the periphery of both main panels is constituted by a fold or score line from which said side panels extend;

wherein one or more of said side panel assemblies includes an outer wall panel and an inner wall panel, said outer wall panel extending from a proximal fold or score line in common with the fold or score line at the periphery of the adjoining main panel and said inner wall panel extending from a distal fold or score line remote from the proximal fold or score line; and wherein one or more of said side panel assemblies further include one or more lines of weakness circumscribing one or more removable portions from a remaining panel portion, the remaining panel portion being sufficient that the enclosing and/or strength properties of the container when assembled from the blank remain substantially unaffected upon removal of any one or more of said removable portions.

In another aspect, this invention resides broadly in a method of promoting goods and/or services including:

providing a container having one or more removable portions as herein described; and providing markings on the removable portions indicating promotional advertising, discounts, prizes, special offers or the like.

Preferably, at least some of the promotional advertising, discounts, prizes, special offers or the like is from one or more suppliers other than the supplier of the product contained in the container.

In another aspect, this invention resides broadly in a method of decreasing overheads of a business providing goods in a container, the method including:

providing one or more removable portions in operative association with the container;

obtaining payment from one or more other businesses to advertise other goods and/or services; and providing markings on the removable portions indicating the advertising of the other businesses thereon whereby the cost of the advertising and at least some of the overhead associated with the production of the container may be offset by the payment obtained from the other businesses.

Preferably the container is a container with integral removable portions as hereinbefore described. However, the invention may be performed with containers of the prior art having removable portions attached thereto. In that case the removable portions could be attached to the container by any means as is known in the art but conveniently could be in the form of stickers.

The advertising may be by way of promotional indications, discounts, prizes, special offers or the like promised by way of the markings on the removable portions.

It is preferred that one or more of the removable portions is provided with a unique identifier, preferably a barcode, so that customer acceptance and usage of the promotional offers can be monitored.

BRIEF DESCRIPTION OF THE DRAWINGS

In order that the invention may be more readily understood and put into practical effect, reference will now be made to the accompanying drawings which illustrate a range of containers according to the invention, all in pattern development form, for a blank which may be folded to form a container for a pizza style pie, and wherein:

FIGS. 12A, 12B, 12C, 12D and 12E have a wall height that is greater than the other designs and are examples of a lunch-box or airline food container.

FIGS. 12F, 12G, 12H, 12I, 12J, 12K, 12L, 12M, 12N and 12O, are for open (or lidless) containers that also can serve as a lid for a container.

Figure 1A:
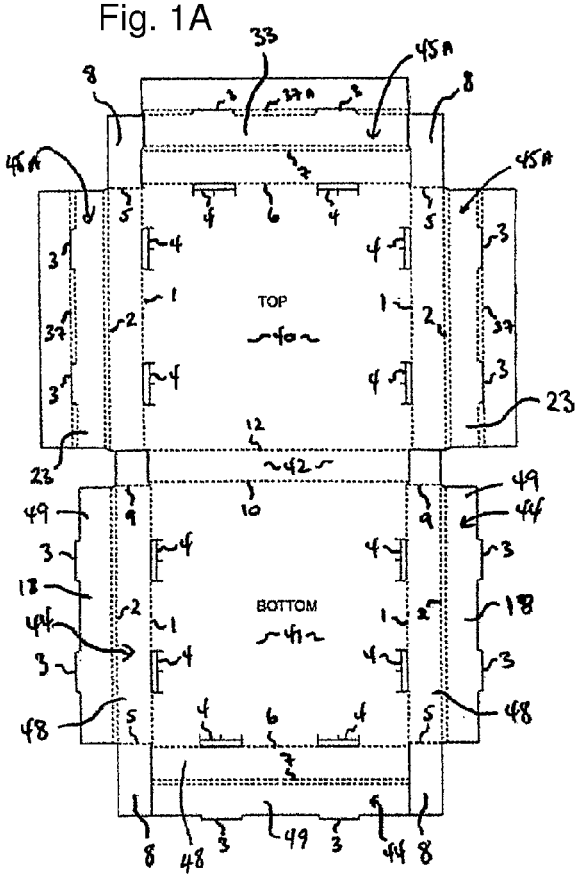
FIG. 1A is for a container that may be adapted to include one or more removable panels.

Each of the containers shown in FIGS. 1-11B and 1R-5R has a top panel 40 and a bottom panel 41 joined together by a joining panel 42 along a bottom hinge line 10 between the bottom panel and the joining panel and a top hinge line 12 between the top panel and the joining panel. The top and bottom panels are substantially square and the joining panel is relatively narrow (compared to its width) such that a relatively shallow container is provided for enclosing pizza style pies.

Each of the containers shown has a top panel 40 and a bottom panel 41 joined together by a joining panel 42 along a bottom hinge line 10 between the bottom panel and the joining panel and a top hinge line 12 between the top panel and the joining panel. The top and bottom panels are substantially square and the joining panel is relatively narrow (compared to its width) such that a relatively shallow container is provided for enclosing pizza style pies.

Figure 5R:
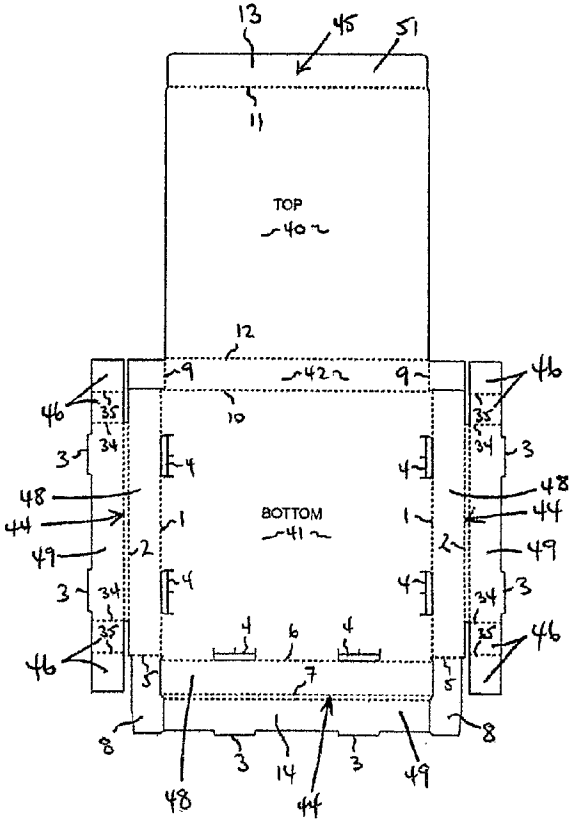
Figure 7A:
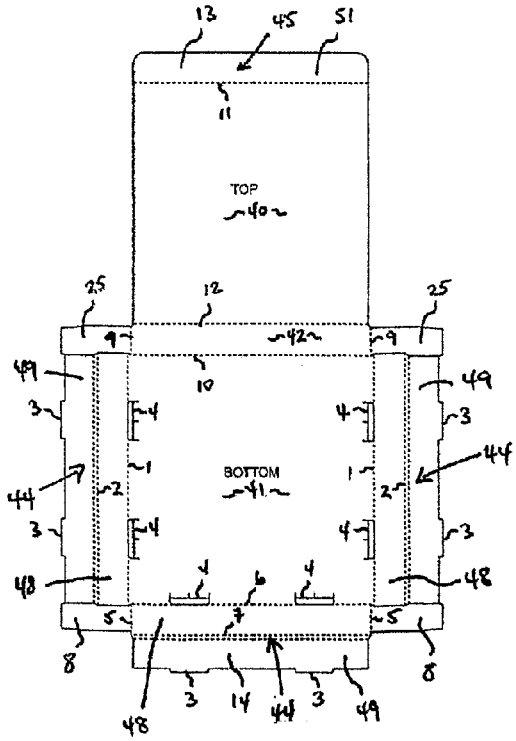
FIGS. 7A to 7H are for containers having further variations from those in previous Figs.
Figure 7B:
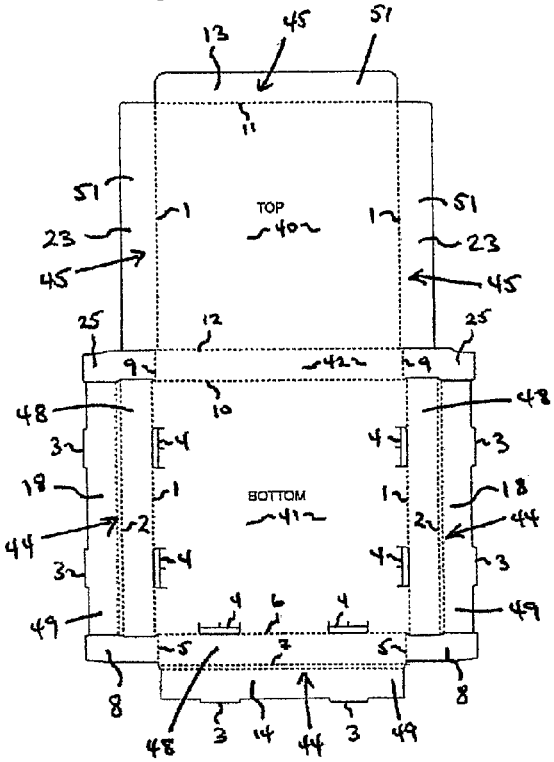
Figure 7C:
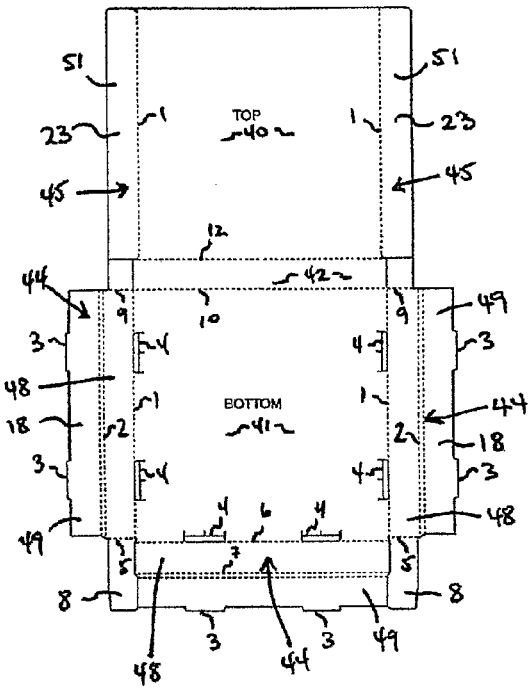
Figure 7D:
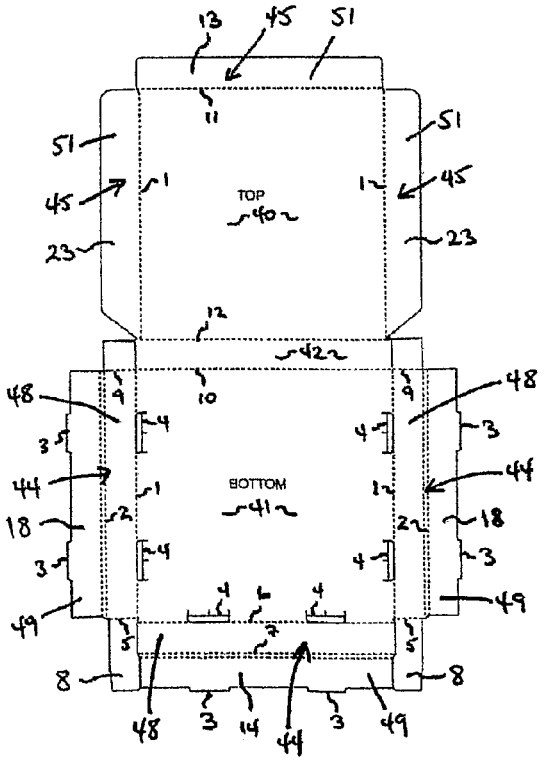
Figure 7E:
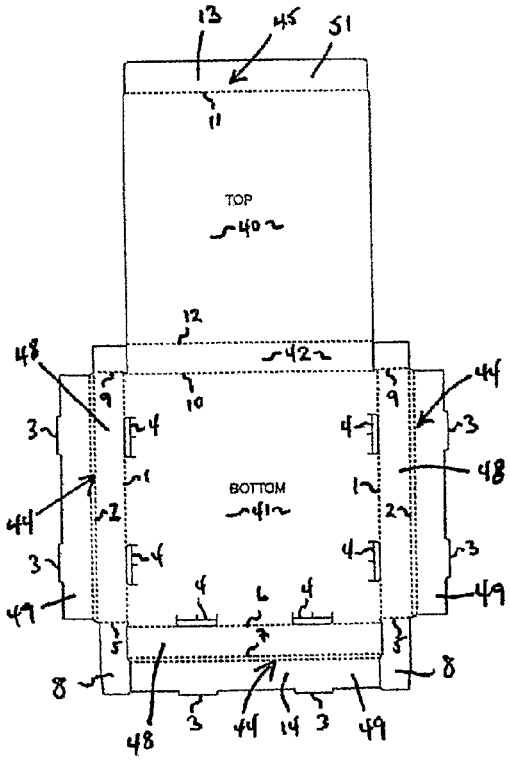

Side walls extend from the three edges of each top and bottom panel of all but the containers shown in FIGS. 5R, 7A and 7E, where the top panel has only one side wall extending from the edge remote from the top hinge line, and FIG. 7C, where the top panel has two side walls, one extending from each of the edges adjacent the top hinge line. There are two basic styles of side wall, a "roll-over" style side wall shown at 44 in FIG. 1 and a simple, single-layer side wall shown at 45 in FIG. 2A. In FIG. 1, a "triple" roll-over style wall 45*a* is provided on three sides of the top panel. It will be appreciated that roll-over walls can be made up of more than two or three layers if desired. Apart from the examples shown in FIGS. 5R, 7A, 7C and 7E, where some of the edges of the top panel have no sidewalls, the sidewalls are of either the roll-over style or the single-layer. In FIGS. 10A-D, the two side walls adjacent the top or bottom hinge line include an extension panel 17 extending along the roll-over fold line 15.

Insofar as the roll-over side walls are concerned, each has an inner panel 49 which is first folded about a roll-over fold line designated reference numeral 2 in respect of the side walls adjacent the hinge lines or reference numeral 7 in respect of the side walls opposite the joining panel. The roll-over fold line is constituted by two closely spaced fold lines which enable the outer panels to be folded by bending the sheeting from which the container is formed 180° about the roll-over fold line, or about 90° for each of the closely spaced fold lines, such that the outer panel lies substantially flat against an adjoining inner panel 48.

One or more edge tabs 3 engage with corresponding locking slots 4 when the inner panel is folded to substantially 90° with respect to its adjoining top or bottom panel. The locking slots are aligned along an inner fold line designated reference numeral 1 in respect of the side walls adjacent the hinge lines or reference numeral 6 or 11 in respect of the side walls opposite the joining panel. The edge tabs penetrate at least part way into the locking slots when the roll-over wall is constructed by way of the aforementioned folding of the outer and inner panels with respect to one another and then folding the inner panel along the inner fold line to substantially 90°.

Insofar as the simple sidewalls are concerned, simple sidewall panels 51 are folded at 90° to the top or bottom panel (as the case may be) along the inner fold line.

Some of the side wall panels have side tabs 8, 22, 25 as shown which are inserted between the inner and outer side wall panels of adjacent side walls by following the instructions given in the respective tables associated with each Fig.

In all forms shown, removable portions are shown with reference numeral 46. Where the removable portion is removed from an outer wall panel, support portions 47 are provided intermediate adjacent removable panels.

Once a container according to the invention has been assembled, a pizza style pie may be contained inside it for transport to the location of consumption. One or more removable portions may be removed from the container without substantially affecting the heat retention and/or structural properties of the container. The removable portion, in the form of an offer, coupon or discount may be retained for later use. The offer, coupon or token may be redeemed to receive the consideration promised in association with the offer coupon or token.

The aspects of the invention relating to the method of promoting goods and/or services and the method of decreasing overheads of a business providing goods in a container provide several particular benefits and advantages over the prior art.

"Coupons" are valuable marketing devices for providers of consumer goods or services. Added value is provided to the consumer and the coupons generate more products, profits and goodwill. Promoters and advertisers have used a variety of promotional media in which to gain consumers' attention. Such media have included the more "traditional" forms of advertising and promotion in magazine and newspaper advertisements and in clothing promotions such as caps and shirts. As consumer demands alter, different forms of advertising and promotion are required. The introduction of new types of promotion includes the greater use and acceptance of "coupon promotion" and advertising.

As mentioned hereinabove, pizza boxes represent one of the major cost overheads for pizza restaurants and therefore box manufacturers have made many changes to box design, composition and method of manufacture in an effort to reduce the cost. Given the number of boxes used, a cost saving of as little as 0.5 cents per box is highly significant and can be a major market advantage to a particular box supplier. However, it seems that the cost of manufacture has been reduced to about its limit to the point where there is no more cost to be saved by that means alone. Thus, the only viable means for further cost reduction appears to be in subsidization of the cost of the boxes, for example by an advertiser or promoter. Using a box as described herein, a promoter would pay the box supplier/manufacturer to include a detachable promotion coupon and/or a form of advertisement on the box. That promotion coupon would be redeemable at a relevant participating store or company. A particular promotion could include any product or service.

It is advantageous to include a unique identifier on a coupon in a numeric or similar format, such as a barcode, to allow the promoter to monitor consumer acceptance of the promotion. For example, if a promotion included coupons for several different products on the same type of box and those boxes were distributed in more than one geographical area, by checking the coupons as they are redeemed the promoter can determine that a given product is popular in one area rather than another. Using that information, the promoter can then target that area with the given product in subsequent promotions.

The methods further include the following features:

Improvement and enhancement of quality control, for example by subsidization of the cost of shrink wrapping to improve hygiene in box handling and storage.

Running multiple promotions on the same medium, thereby promoting a range of various products and having the effect of increasing consumers' repeat business by adding value to the consumer without altering the pizza quality or price.

Flexibility of being able to customize promotional material for particular geographic regions, such as regional or metropolitan and similarly to allow for independent franchise distribution.

FIG. 1 in particular is an example of a container in accordance with the invention in which the base has roll-over walls on three sides and the lid has "triple" roll-over walls on the corresponding three sides of the lid. This serves to illustrate that there may be multiple roll-over walls if the structural characteristics of the container material dictate that this is desirable. The container may also be reversed so that the lid acts as the base and vice versa.

Figure 1R:
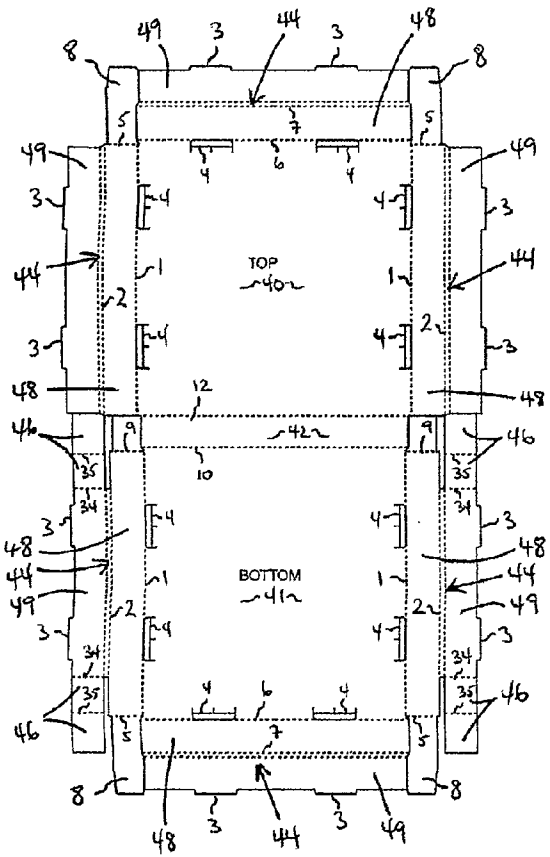

FIG. 1R has roll-over walls on three sides of both the lid and the base, with the outer panel of the roll-over walls of the sides adjacent the bottom hinge line being shortened to provide corner reinforcing by folding the tabs 90° and reverse 90° at fold lines 34 and 35. In such form, a relatively small chamber is provided in the container when assembled, and the chamber helps to reinforce the corner of the container. Additionally, the chamber may be used to enclose additional products, such as sauces, condiments, prizes, gifts, toys, promotional items or the like. The folded tabs (along fold lines 34 and 35) can be made in any suitable or desired length and, by adaptation, can also perform the function of removable portions for coupons.

Figure 2A:
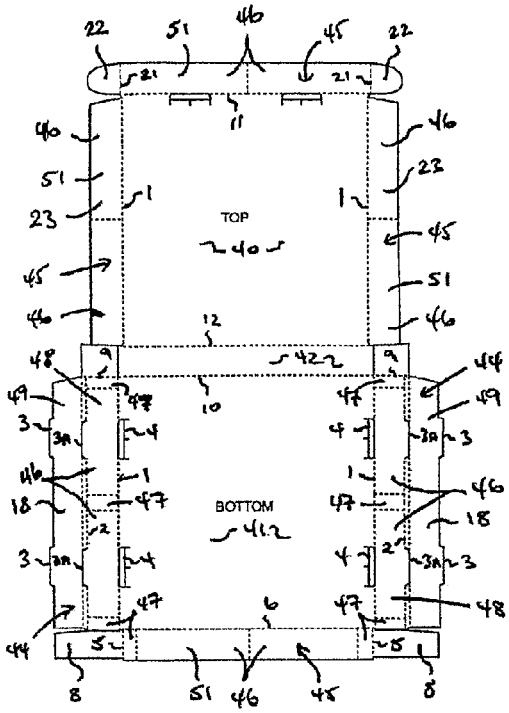
FIGS. 2A and 2B are for two containers each having one or more removable panels forming part of an outer wall panel of roll-over wall and corner holding tabs.
Figure 2B:
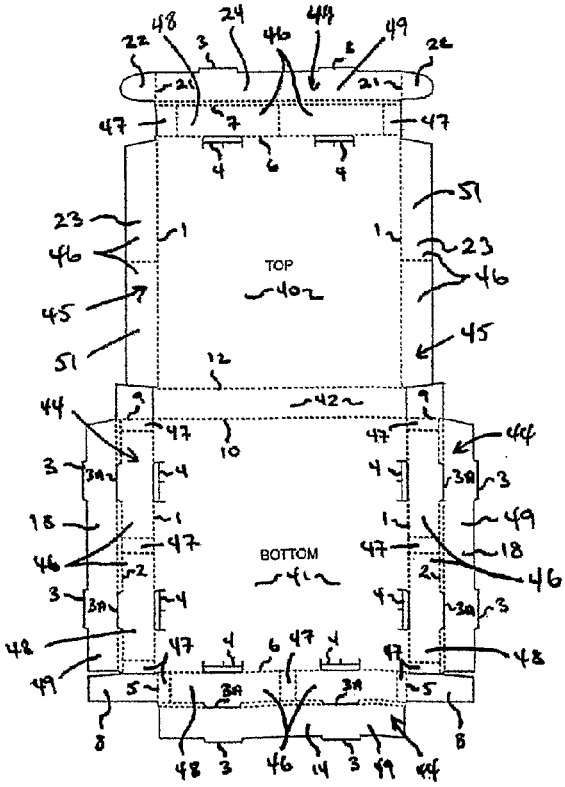
Figure 2R:
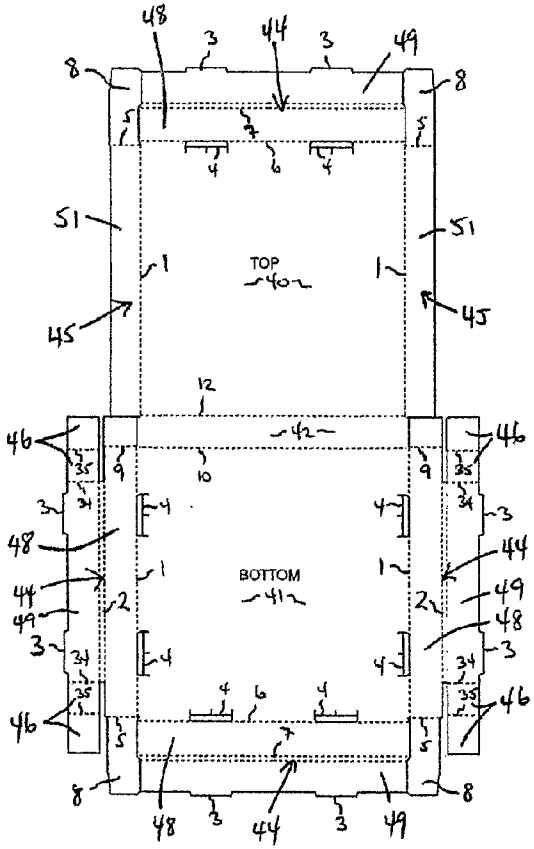

FIGS. 2A and 2B have half-oval tabs 22 extending from side wall panels remote from the joining panel, with roll-over walls and single side walls as shown. FIG. 2R has the corner reinforcing as described in respect of FIG. 1R.

Figure 3A:
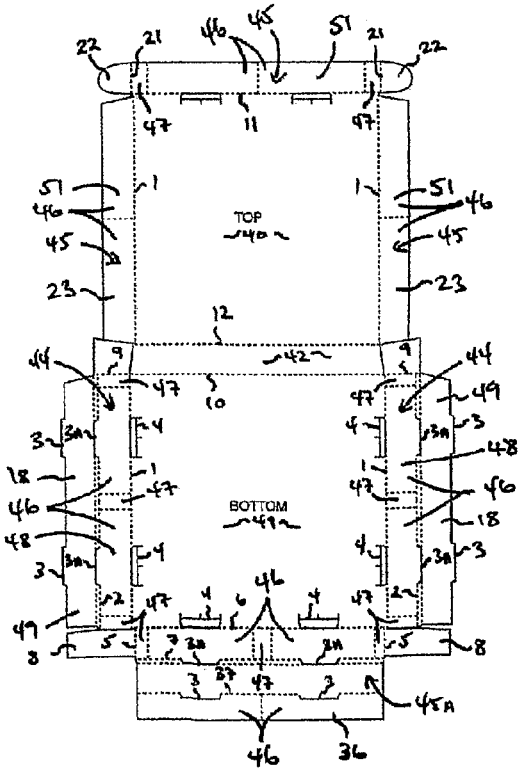
FIGS. 3A and 3B are for containers similar to those of FIGS. 2A and 2B.
Figure 3R:
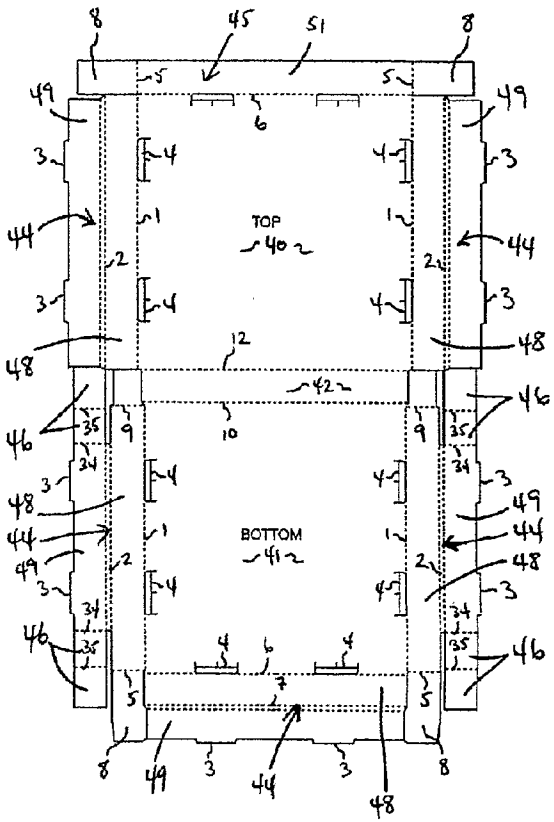
FIGS. 1R, 2R, 3R, 4R and 5R illustrate the containers of FIGS. 6D, 4A, 6A, 7D and 7E, respectively, as examples of how the added feature of corner reinforcing may be incorporated into the designs of the invention.
Figure 3B:
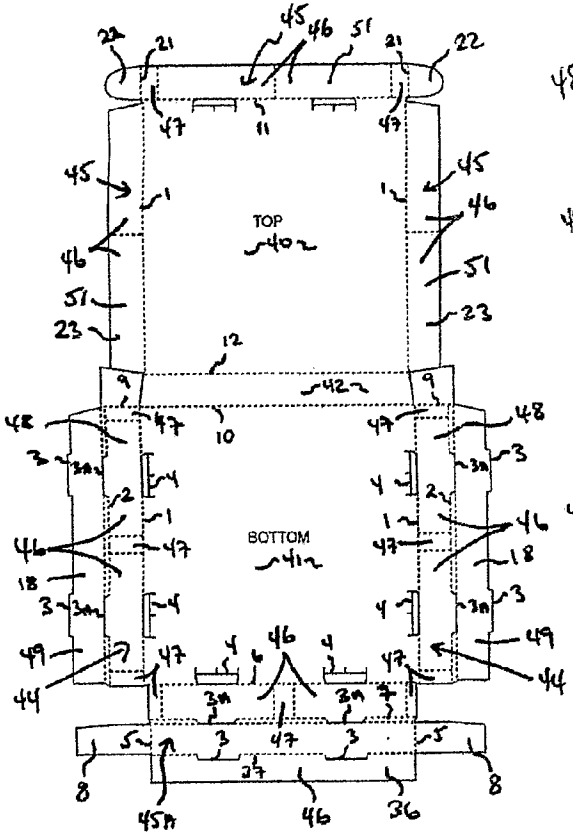

FIGS. 3A and 3B are similar to FIGS. 2A and 2B, except that the corner tabs 8 are at a different location in relation to the remainder of the sidewall panels. Two removable portions are provided on a third wall panel 36, and it will be appreciated that the containers may be "reversed" in that the lid may be used as a base and vice versa. The third wall panel is also provided about three of the sides of the top of the design shown in FIG. 1. As in the case of FIGS. 1R and 2R, the container shown in FIG. 3R has corner reinforcing.

Figure 4R:
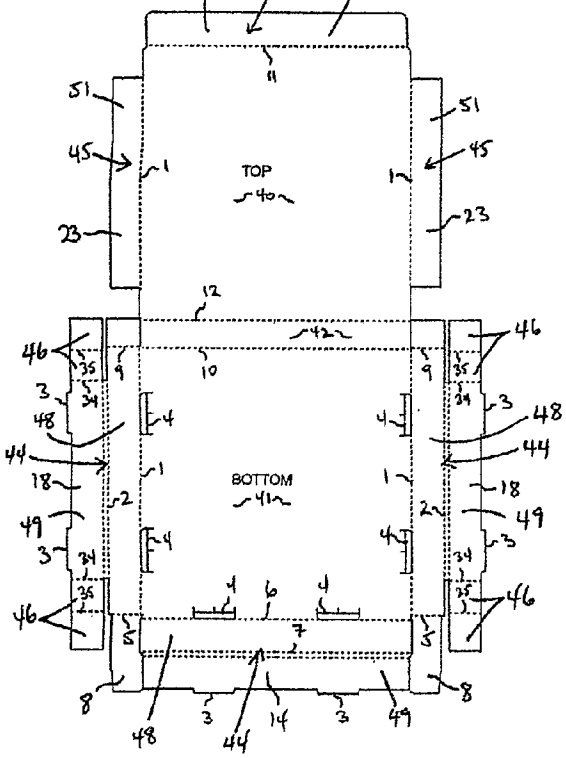
Figure 2S:
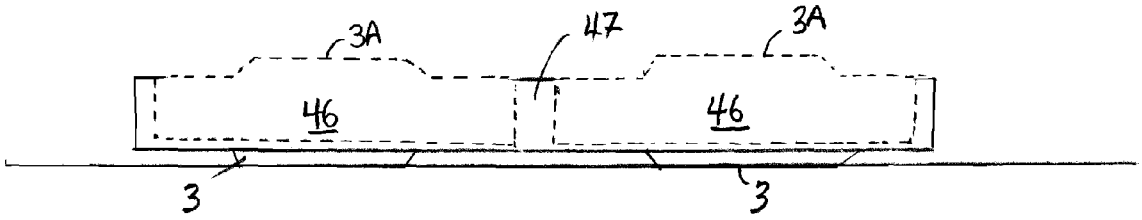
FIG. 2SB is a side view of a pizza box constructed from a blank according to the present invention.
Figure 4B:
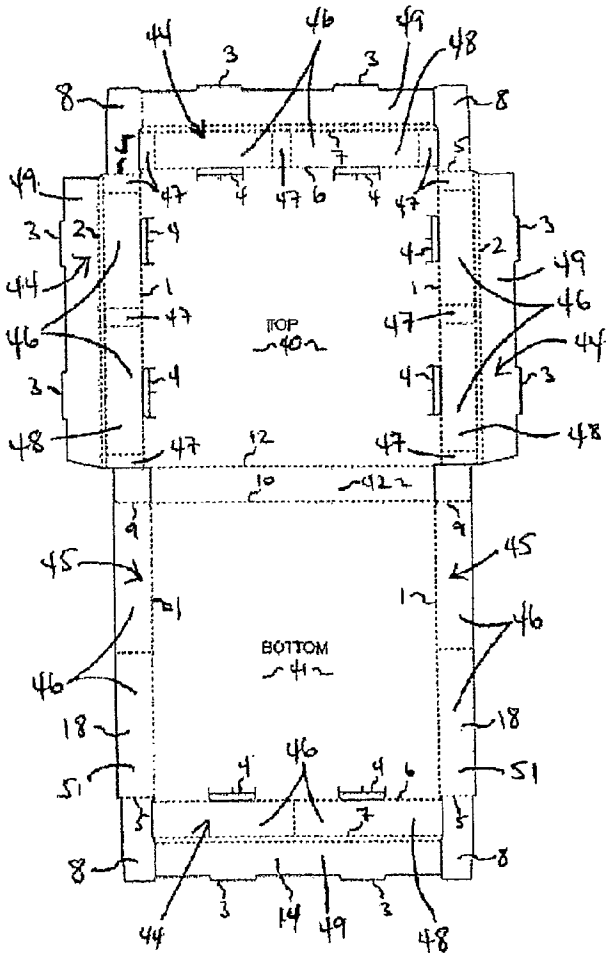
FIGS. 4A, 4B, 4C and 4D are for another form of container which is particularly preferred.
Figure 4A:
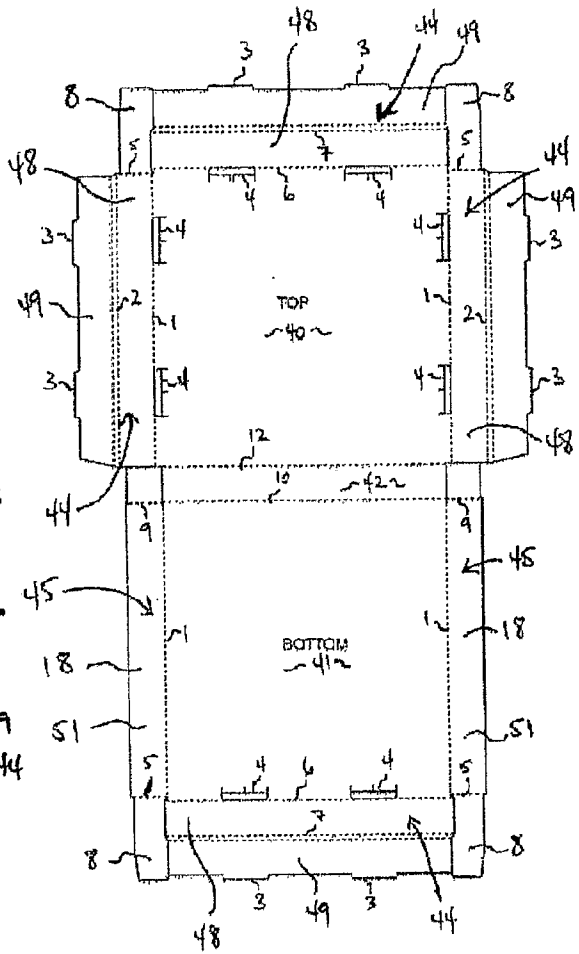
Figure 4D:
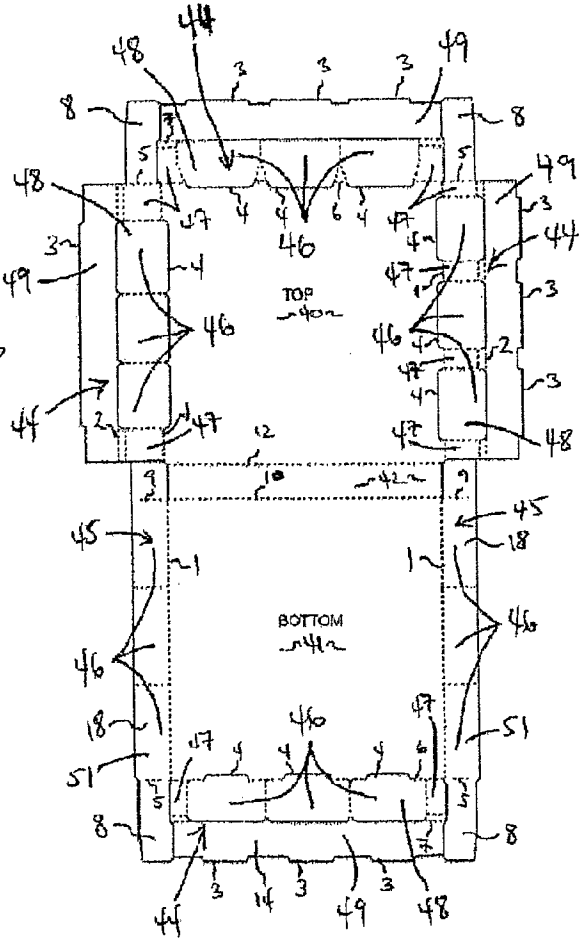
Figure 4C:
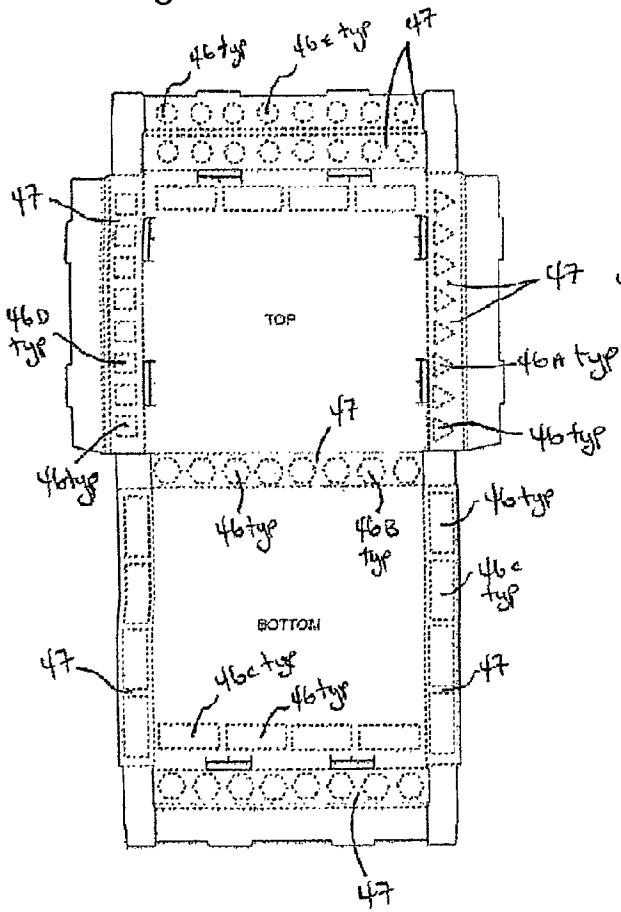

FIGS. 4A, 4B, 4C and 4D show the preferred designs for the container. The example shown in FIG. 4A does not include removable panels according to the invention, but is provided to show a configuration to which such panels may be added if desired. FIG. 4C in particular shows various shapes of removable panel, being triangular as shown typically at 46*a*, hexagonal as shown typically at 46*b*, rectangular as shown typically at 46*c*, square as shown typically at 46*d* and round as shown typically at 46*e*. Of course, a container having several different shapes of removable panel is possible, but it will be appreciated that the form shown in FIGS. 4C and 4D is illustrative only of the range of shapes that could be used, and is not intended to limit the shape of the removable panel to those shown. FIG. 4R illustrates the application of the corner reinforcing similar to the arrangement shown in FIGS. 1R, 2R and 3R.

Figure 5A:
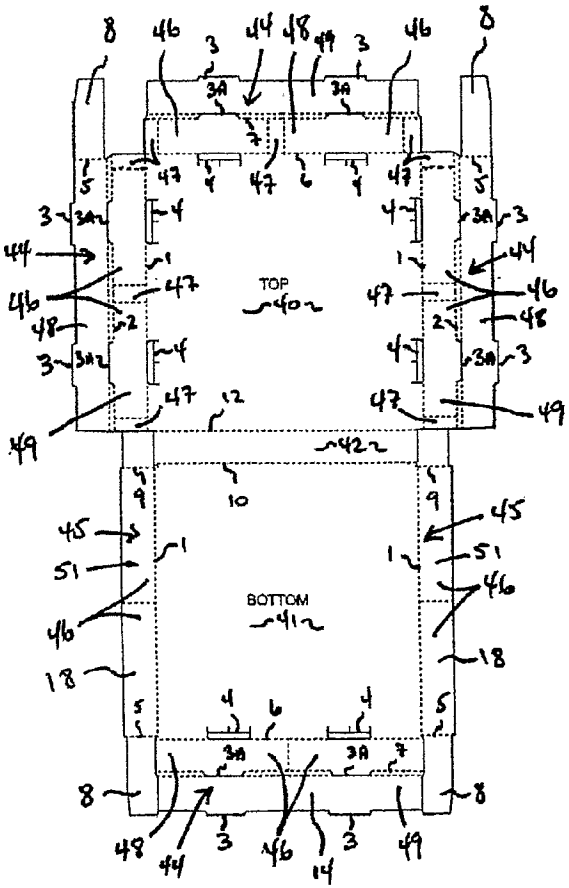
FIGS. 5A and 5B are for containers similar to those of FIGS. 4A, 4B and 4C and which are reversible.
Figure 5B:
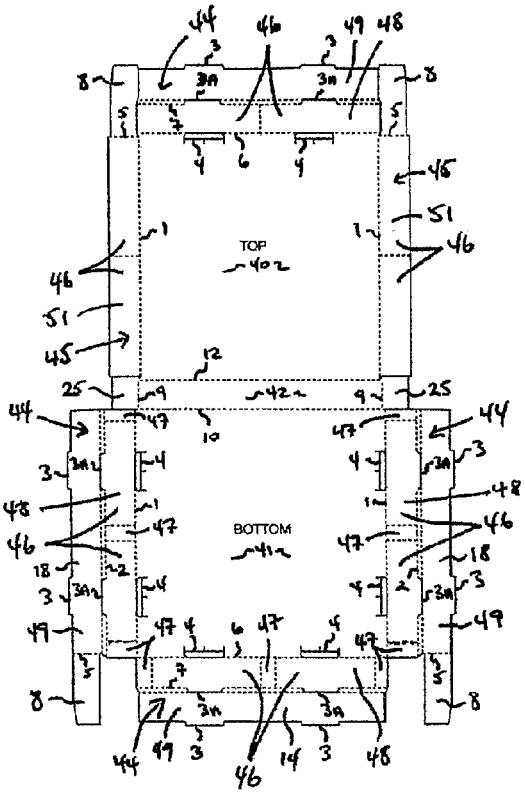

The container shown in FIGS. 5A and 5B include an extra tab 3A extending from the removable panels to facilitate their easy removal from the container. FIG. 5R illustrates the application of the corner reinforcing in the manner hereinbefore described.

Figure 6A:
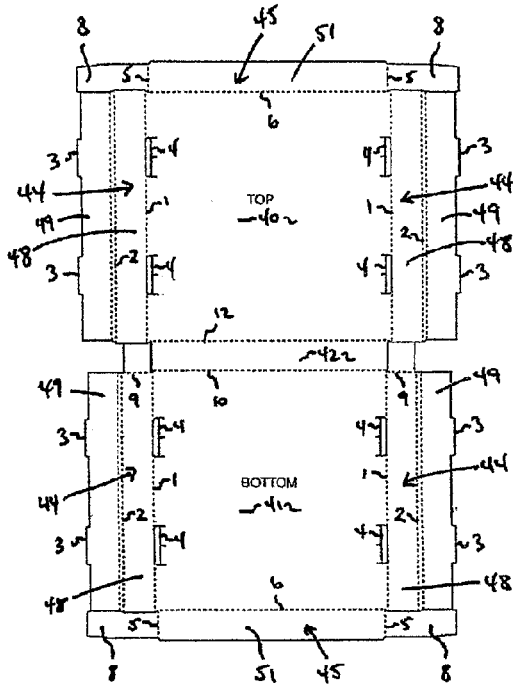
FIGS. 6A to 6F are for containers having variations of the roll-over wall.
Figure 6B:
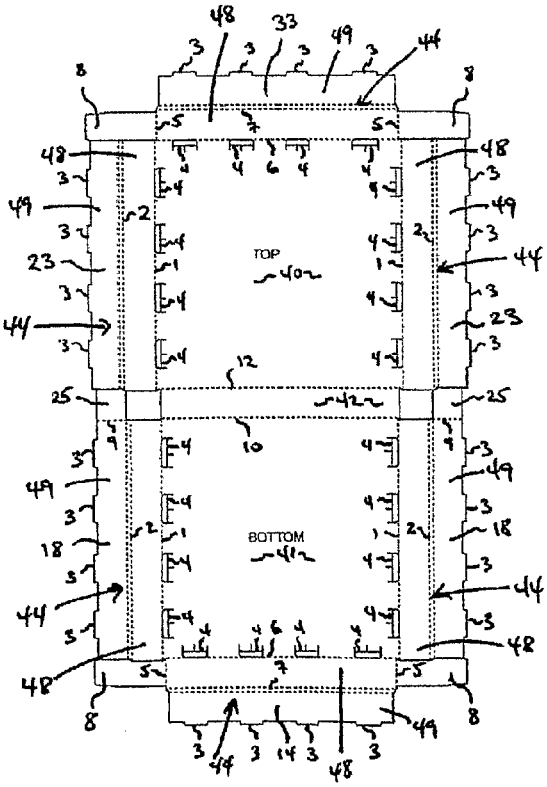
Figure 6C:
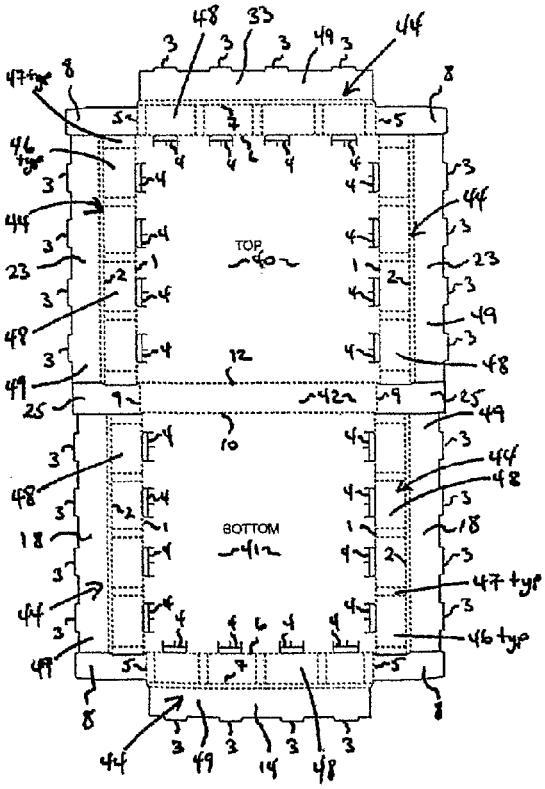
Figure 6D:
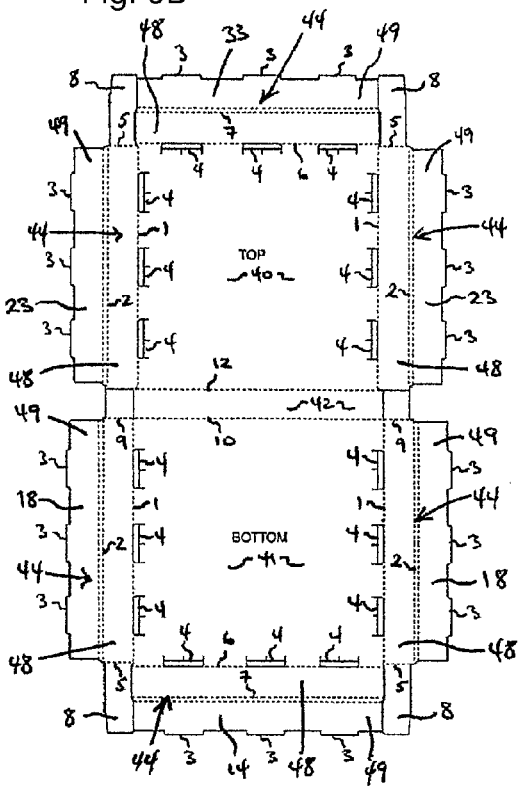
Figure 6E:
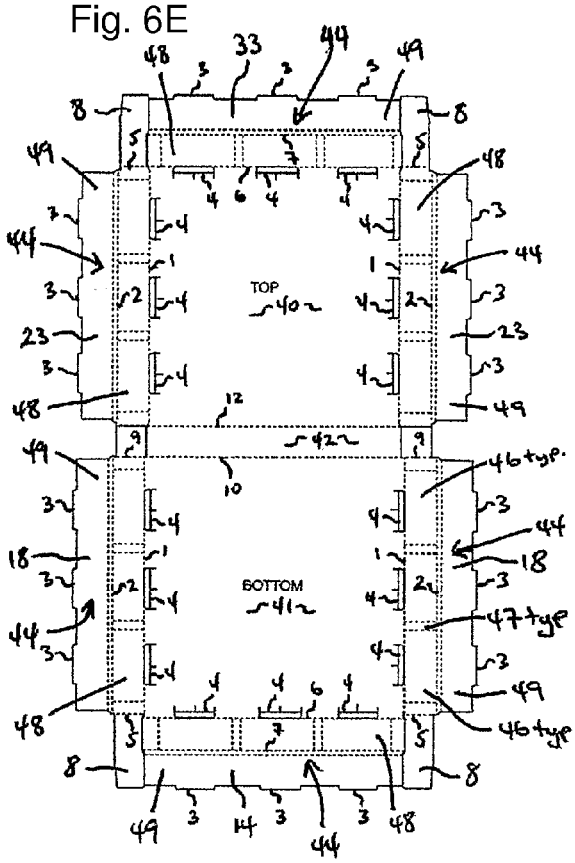
Figure 6F:
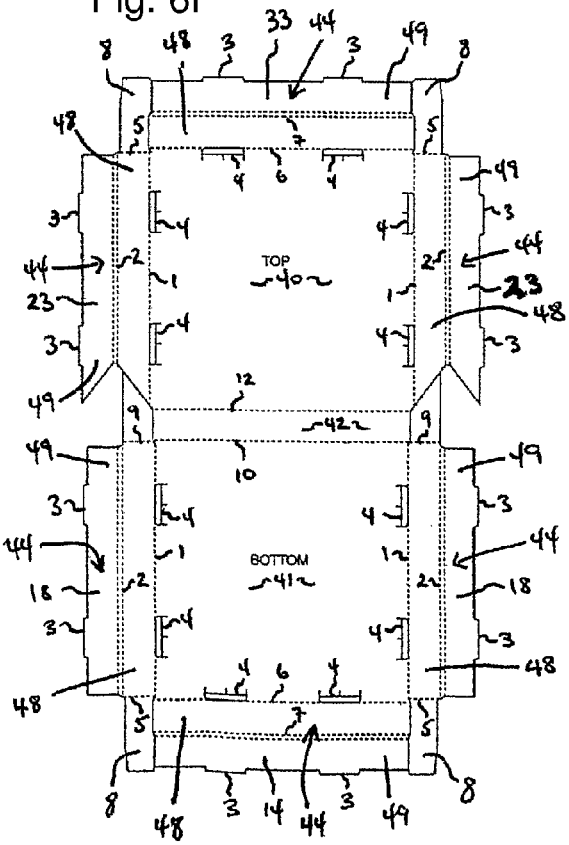

FIGS. 6A to 6F show variations of the roll-over wall. Each container shown therein is reversible. FIG. 6A shows a basic blank without removable panels. FIG. 6B has the corner reinforcing panel 25 attached to the inner wall panel instead of the outer wall panel, and has extra tabs 3 and 4, and roll-over walls along the edges of the top and bottom panels remote from the joining panel, indicated by reference numerals 33 and 14. FIG. 6C has the removable coupons shown in accordance with the invention, and has the corner reinforcing panel 25 attached to the joining panel 42 instead of sidewall 18. FIGS. 6D to 6F have the corner reinforcing tabs 8 attached to the side walls 18 and 23 instead of the front walls 14 and 33. FIG. 6E has three removable coupons per side wall and FIG. 6F shows an example of an alternative shape of the ends of the side walls on the lid, the ends being cut off at a slant rather than at 90° to the fold line.

Figure 7F:
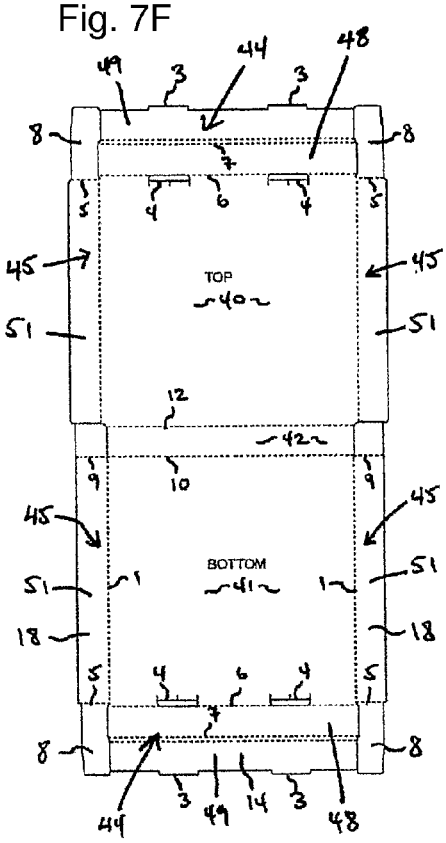
Figure 7G:
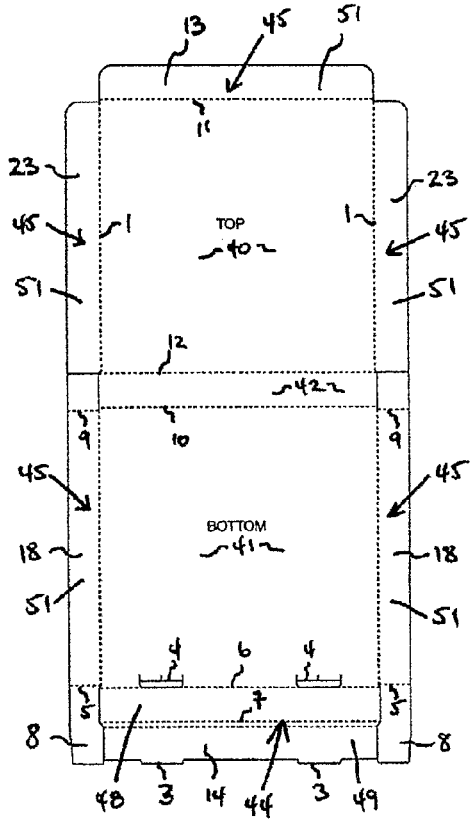
Figure 7H:
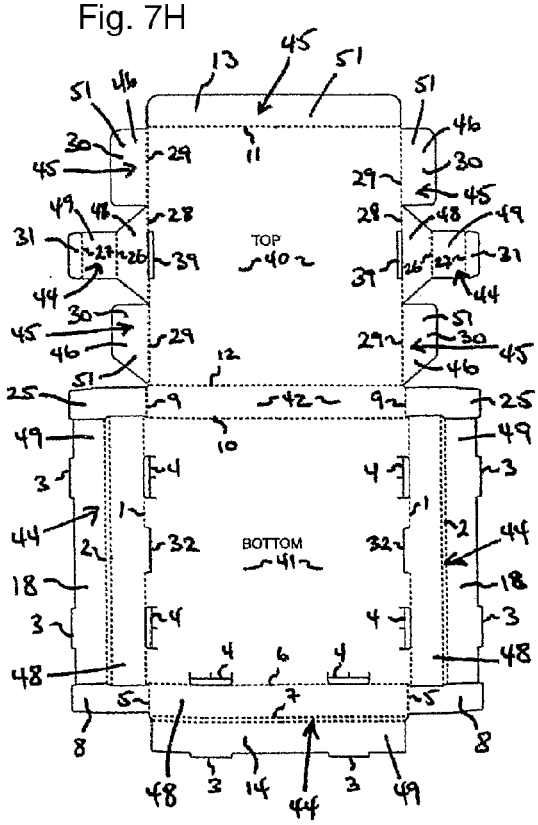

FIGS. 7A through 7H show further variations. FIG. 7A shows a basic blank without removable panels. FIG. 7B is the same as FIG. 7A, but includes single sidewall panels 23. FIG. 7C has panel 8 attached to panel 18 rather than panel 14 and panel 25 attached to panel 18 rather than panel 42, and panel 13 removed. FIG. 7D shows a slight variation of panel 23. FIG. 7E is similar to FIG. 7A except that panels 25 and 8 are attached to panel 18 instead of panels 42 and 14. FIG. 7F shows a basic roll-over panel for the front walls 14 and 33 only. FIG. 7G shows an example where the roll-over wall on the front wall 33 has been replaced by a single wall panel 13, and the corner reinforcing tab 8 has been removed. The top panel also fits inside the bottom panel. FIG. 7H shows a somewhat different approach to providing the removable panels in relation to the sidewalls of the container according to the invention.

Figure 8A:
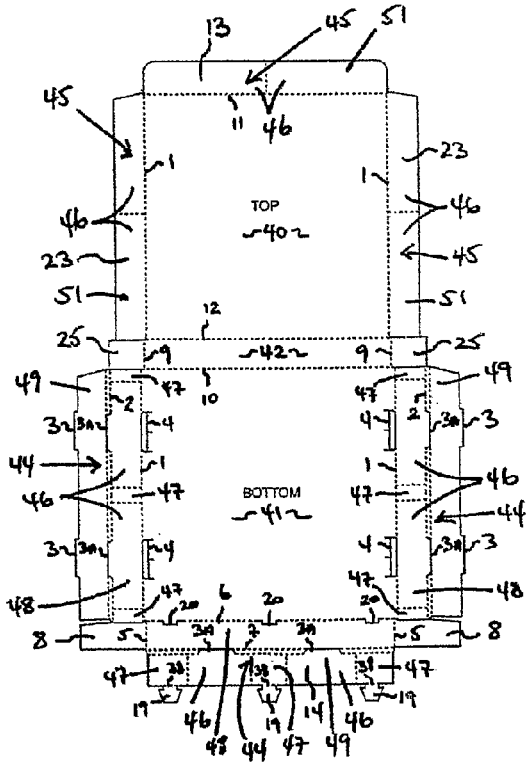
FIGS. 8A, 8B and 8C are for containers wherein the inner and outer walls are transposed.
Figure 8B:
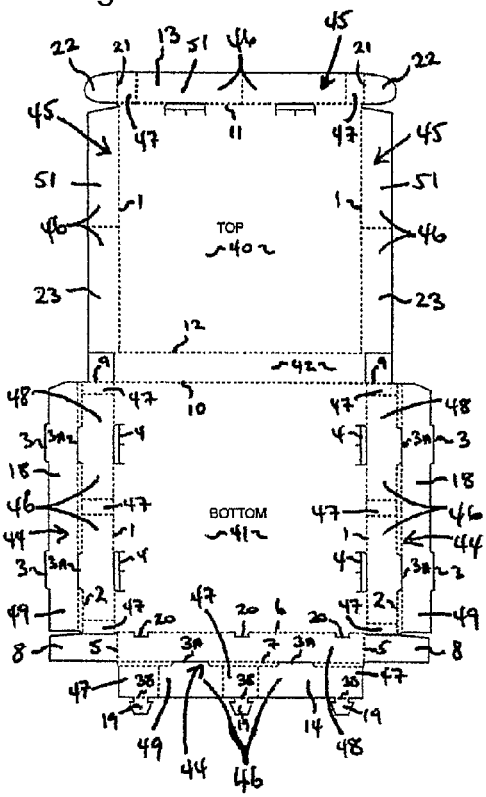
Figure 8C:
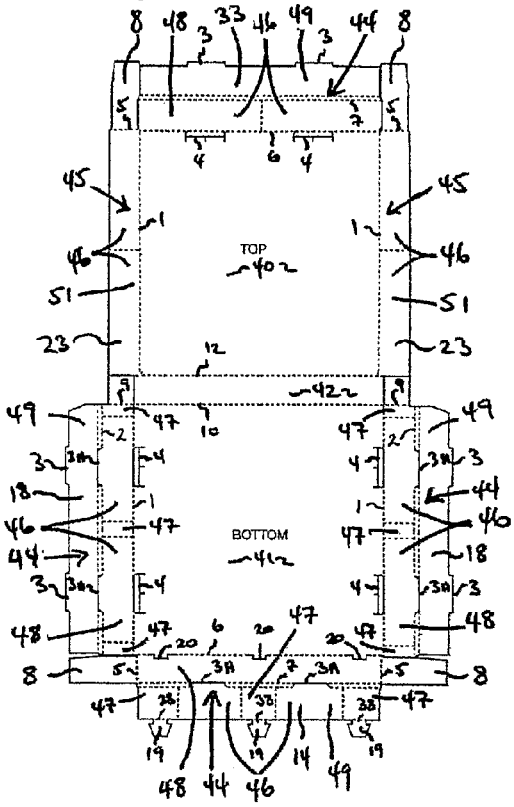
Figure 9A:
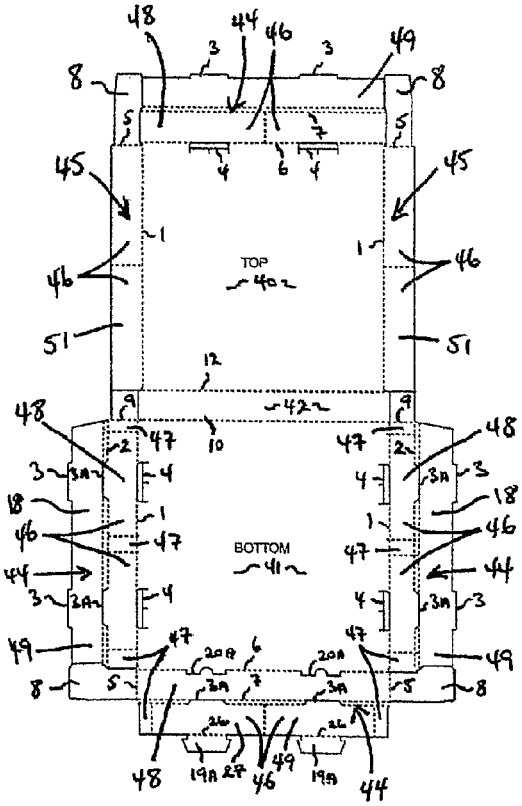
FIGS. 9A and 9B are for containers having bigger slots.
Figure 9B:
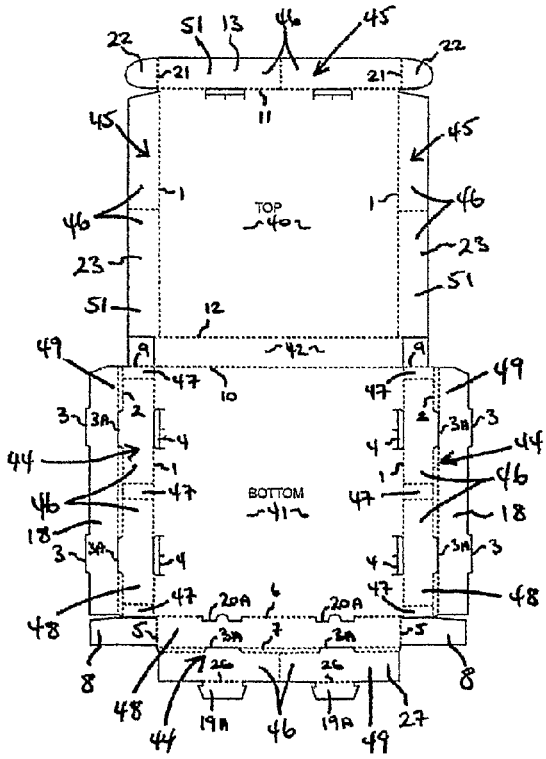

FIGS. 8A, 8B and 8C show alternative designs in which the inner and outer walls are swapped in terms of having the removable panels on the inside of the roll-over walls, with further variations in terms of the placement of corner reinforcing panels 25, half-oval tabs 22 and a roll-over wall for the front wall of the lid as the case may be. Some of the inner wall panels also include three tab extensions 19, which each engage with a respective small slot 20 formed along the fold line 6. In FIGS. 9A, 9B and 10D, the tab extensions 19*a* and small slots 20*a* are slightly larger than in FIGS. 8A, 8B and 8C.

Figure 10A:
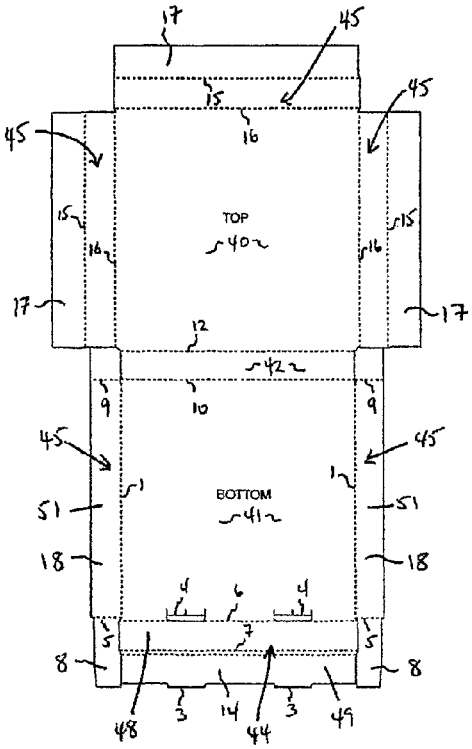
FIGS. 10A to 10D are for containers having different shaped panels to accommodate different formats of coupon.
Figure 10B:
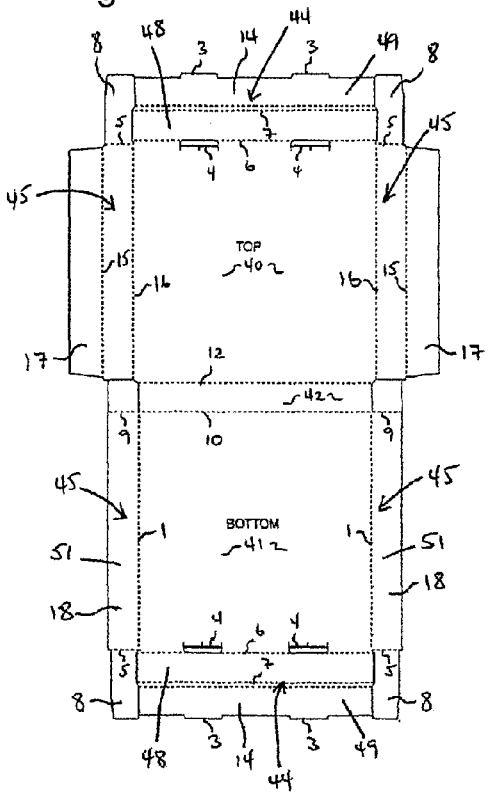
Figure 10C:
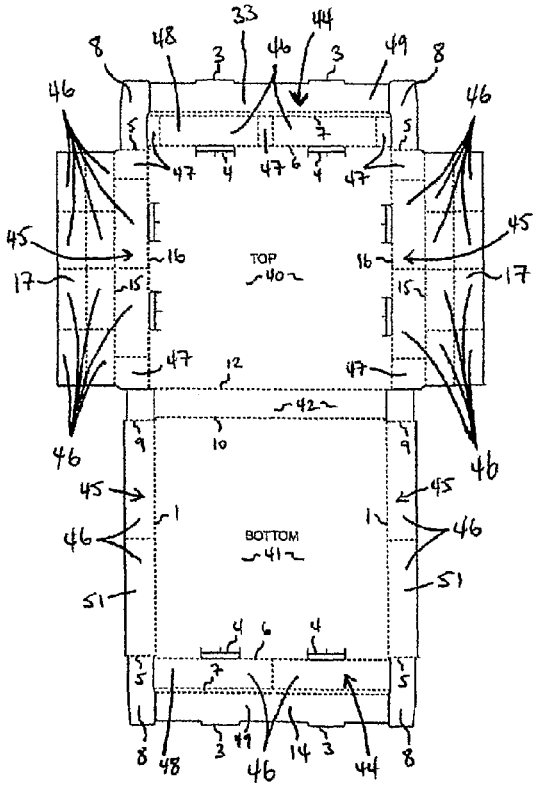
Figure 10D:
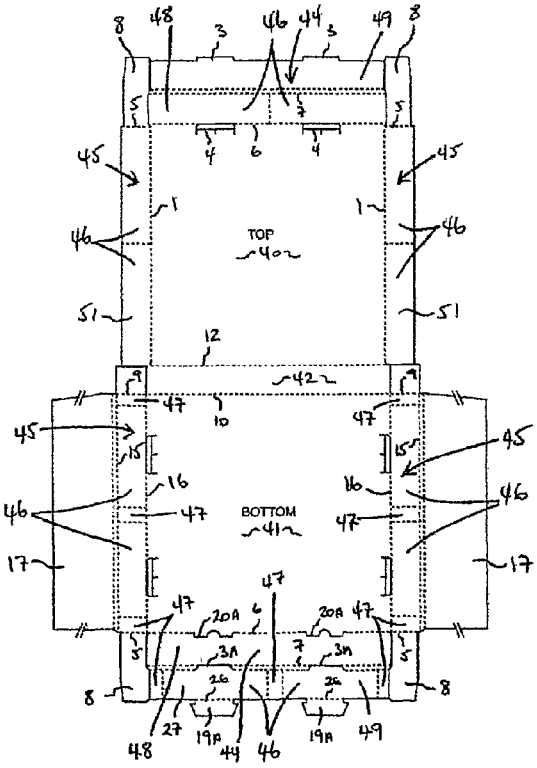

In FIGS. 10A-D, a distal panel 17 is provided which does not necessarily form a roll-over wall, but may be folded to an angle between 180° and 90° (but could also, for example, be folded to about 90° so that the side wall has an L-shaped section). FIGS. 10C and 10D in particular show that the distal panel 17 can be of an extended width to provide a larger number of removable panels or a larger size of removable panel respectively, but it will be seen that FIGS. 10A, 10B and 10D share many of the same features as FIG. 10C.

Figure 11B:
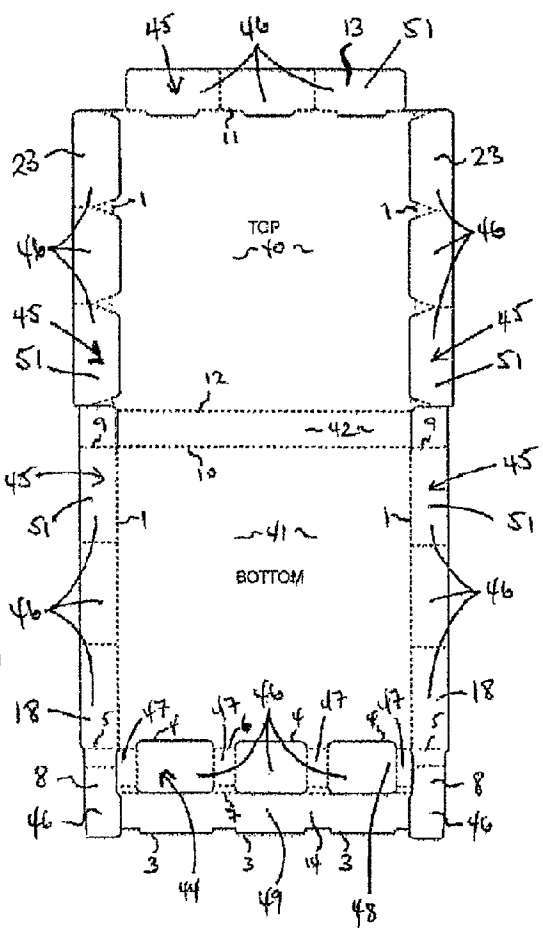
FIGS. 11A and 11B are variants in which 11A has added coupons on flap 8 and in which 11B has panel 23 sitting on the outside of panel 18.
Figure 11A:
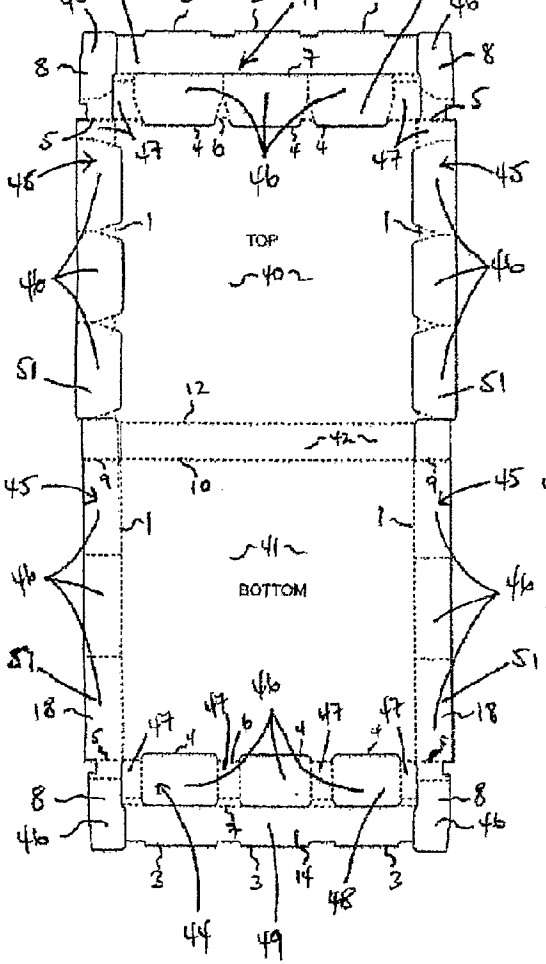

In FIG. 11A there are added coupons 46 on flap 8 that are easier to detach; whilst in FIG. 11B panel 23, having coupons 46, may sit either inside or outside panel 18.

Figure 12A:
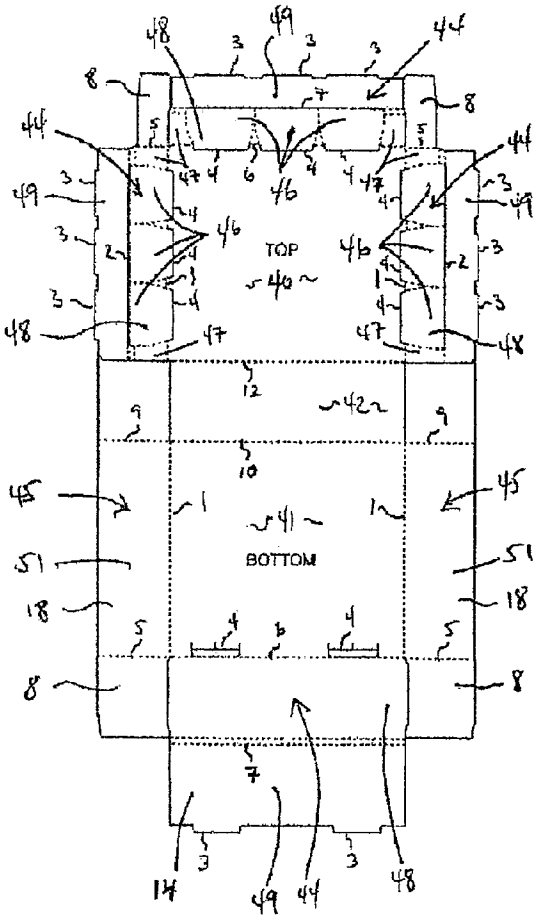

FIG. 12 shows a design having high side walls that is suitable for use as a lunch box or for an airline food container. This is an example of an alternative form of food container provided for the convenience of fast-food consumers and travelers. Other examples are illustrated in FIGS. 12B, 12C, 12D and 12E.

In FIGS. 12B, 12C and 12D, the main panel is made up by joining together numerous panels 41. FIGS. 12B, 12C, 12D, 12E, 12G, 12H, 12J, 12K, 12L, 12M and 12N may have glued points 50. FIGS. 12B, 12C, 12D, 12E, 12J, 12K, 12L and 12M have a line of weakness 52 so that the container can be transported in a flat format. FIGS. 12B, 12C, 12D and 12E are arranged to have an easy assembly method by simply opening the container.

FIGS. 12F, 12G, 12H, 12I, 12J, 12K, 12L, 12M and 12N illustrate further open (or lidless) containers to which the roll-over wall can be applied. These containers can also be used as a lid, if desired.

FIG. 12O shows a container with two main panels 41 on the base of the container.

Figure 1S:
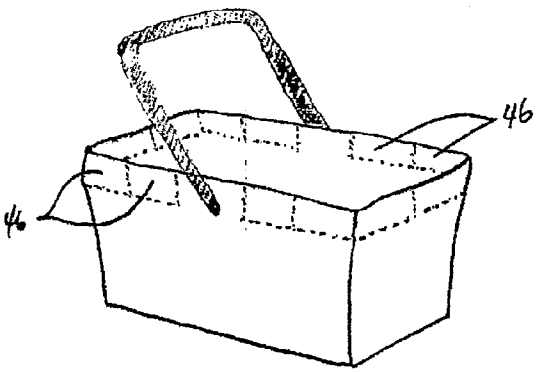
FIG. 1SB shows a design for a shopping basket with removable coupons around its open upper edge.

FIG. 1SB shows a shopping basket with removable coupons 46 around the upper edge of the container. The container is provided with a pivotally mounted handle 60; but other embodiments may have alternatives. The container may be made with any desired number of sides and also can have a lid, if desired. The container can be of cardboard and glued together or it can have a roll-over fold construction in a similar fashion to the pizza box examples given herein.

It will be appreciated that where containers have been described as being without removable panels in relation to the drawings, removable panels may be provided by adaptation of the pattern developments described as being in accordance with the present invention.

The containers in accordance with the present invention may be used for reducing the overheads of a business that requires goods to be enclosed in a container or containers. Where corner reinforcing is provided in accordance with the invention, extra goods, such as, for example, in the case of a pizza box in accordance with the invention, extra sauce or sauces, condiments, prizes, gifts, toys, promotional items and the like may be provided in the chamber formed by the corner reinforcing.

Although the invention has been described with reference to a selection of illustrative examples, it will be appreciated by persons skilled in the art that the invention may be embodied in other forms within the broad scope and ambit as herein set forth.

APPENDIX 1

Assembly Instructions with Reference to the Figures

FIG. 1

A. Fold Bottom panel (1) 90° B. Fold Bottom panel (2) 180° C. Slot (3) into (4) D. Fold (5) 90° E. Repeat A to D on the opposite side F. Fold Bottom panel (6) 90° G. Fold Bottom panel (7) 180° around (8) H. Slot (3) into (4) I. Fold (37) 180° or Reverse 90° J. Fold Top panel (1) 90° K. Fold Top panel (2) 180° L. Slot (3) into (4) M. Fold (5) 90° N. Repeat I to N on the opposite side O. Fold (37A) 180° or Reverse 90° P. Fold Top panel (6) 90° Q. Fold Top panel (7) 180° around (8) R. Slot (3) into (4) S. Fold (9) 90° on both sides T. Fold (10) 90° U. Fold (12) 90° till Top panel sits over the top of Bottom panel and (33)+(23) are sitting on the outside walls of (14)+(18).

FIG. 2A

A. Fold (6) 90° B. Fold (5) 90° both sides C. Fold Bottom panel (1) 90° D. Fold Bottom panel (2) 180° around (8) E. Slot (3) into (4) F. Repeat C to E to the opposite side G. Fold Top panel (1) 90° on both sides H. Fold (11) 90° I. Fold (21) 90° on both sides J. Fold (9) 90° on both sides K. Fold (10) 90° L. Fold (12) 90° until (22) is slotted into the opening of (18) on both sides and to place (23) on the inner walls of the Bottom panel (18).

FIG. 2B

A. Fold Bottom panel (6) 90° B. Fold Bottom panel (7) 180° C. Slot (3) into (4) D. Fold (5) 90° on both sides E. Fold Bottom panel (1) 90° F. Fold (2) 180° around (8) G. Slot (3) into (4) H. Repeat E to G to opposite side I. Fold Top panel (6) 90° G. Fold Top panel (7) 180° K. Slot (3) into (4) H. Fold (21) 90° on both sides I. Fold (9) 90° on both sides J. Fold Top panel (1) 90° on both sides K. Fold (10) 90° L. Fold (12) 90° till (22) is slotted into the opening of (18) on both sides and place (23) on the inner walls of the Bottom panel (18).

FIGS. 3A & 3B

A. Fold (6) 90° B. Fold (37) 180° or Reverse 90° C. Fold (7) 180° and (36) will sit flat on the Bottom panel D. Slot (3) into (4) E. Fold (5) 90° F. Fold Bottom panel (1) 90° G. Fold (2) 180° around (8) H. Slot (3) into (4) I. Repeat E to H on the opposite side J. Fold Top panel (1) 90° on both sides K. Fold (11) 90° L. Fold (21) 90° on both sides M. Fold (9) 90° on both sides N. Fold (10) 90° O. Fold (12) 90° until (22) is slotted into the opening of (18) on both sides and to place (23) on the inside of the bottom panel (18).

FIGS. 4A, 4B, 4C & 4D

A. Fold Bottom Panel (1) 90° on both sides B. Fold Bottom panel (5) 90° on both sides C. Fold Bottom panel (6) 90° D. Fold Bottom panel (7) 180° around (8) E. Slot (3) into (4) F. Fold Top panel (1) 90° on both sides G. Fold Top panel (2) 180° on both sides H. Slot (3) into (4) I. Fold Top panel (5) 90° on both sides J. Fold Top panel (6) 90° K. Fold Top panel (7) 180° around (8) L. Slot (3) into (4) M. Fold (9) 90° on both sides N. Fold (10) 90° O. Fold (12) 90° till Top panel sits over the outer walls of (14)+(18).

FIG. 5A

A. Fold Bottom panel (1) 90° on both sides B. Fold Bottom panel (5) 90° on both sides C. Fold Bottom panel (6) 90° D. Fold Bottom panel (7) 180° around (8) E. Slot (3) into (4) F. Fold Top panel (1) 90° G. Fold Top panel (2) 180° H. Slot (3) into (4) I. Fold Top panel (5) 90° J. Repeat F to I on the opposite side K. Fold Top panel (6) 90° L. Fold Top panel (7) 180° around (8) M. Slot (3) into (4) N. Fold (9) 90° O. Fold (10) 90° P. Fold (12) 90° till Top panel sits over the outer walls of (14)+(18).

FIG. 5B

A. Fold (9) 90° B. Fold (10) 90° C. Fold Bottom panel (1) 90° D. Fold Bottom panel (2) 180° around (25) E. Slot (3) into (4) F. Repeat C to E on the opposite side G. Fold Bottom panel (5) 90° on both sides H. Fold Bottom panel (6) 90° I. Fold Bottom panel (7) 180° around (8) J. Slot (3) into (4) K. Fold Top panel (1) 90° on both sides L. Fold Top panel (5) 90° on both sides M. Fold Top panel (6) 90° N. Fold Top panel (7) 180° around (8) O. Slot (3) into (4) P. Fold (12) 90° till Top panel sits inside Bottom panel walls of (14)+(18).

FIG. 6A

A. Fold Bottom panel (6) 90° B. Fold Bottom panel (5) 90° C. Fold Bottom panel (1) 90° D. Fold Bottom panel (2) 180° around (8) E. Slot (3) into (4) F. Repeat B to E on the opposite side G. Repeat A to F on the Top panel H. Fold (9) 90° on both sides 1. Fold (10) 90° J. Fold (12) 90° till the Top panel is sitting over the Bottom panel.

FIG. 6B

A. Fold Bottom panel (6) 90° B. Fold Bottom panel (7) 180° C. Slot (3) into (4) D. Fold Bottom panel (5) 90° E. Fold Button panel (1) 90° F. Fold Button panel (2) 180° around (8) G. Slot (3) into (4) H. Repeat D to G on the opposite side I. Repeat A to H on the Top panel J. Fold (9) 90° on both sides K. Fold (10) 90° L. Fold (12) 90° till Top panel sits over the top of the Bottom panel and (33)+(23) is sitting on the outside walls of (14)+(18).

FIG. 6C

A. Fold Bottom panel (6) 90° B. Fold Bottom panel (7) 180° C. Slot (3) into (4) D. Fold (10) 90° E. Fold (9) 90° F. Fold Bottom panel (5) 90° G. Fold Button panel (1) 90° H. Fold Button panel (2) 180° around (8)+(25)1. Slot (3) into (4) J. Repeat E to I on the opposite side K Repeat A to C on the Top panel L. Fold Top panel (5) 90° M. Fold Top panel (1) 90° N. Fold Top panel (2) 180° around (8) O. Slot (3) into (4) P. Repeat L to O on the opposite side Q. Fold (12) 90° till Top panel sits over the top of the Bottom panel and (33)+(23) is sitting on the outside walls of (14)+(18).

FIGS. 6D, 6E & 6F

A. Fold Bottom panel (1) 90° B. Fold Bottom panel (2) 180° C. Slot (3) into (4) D. Fold (5) 90° E. Repeat A to D on the opposite side F. Fold Bottom panel (6) 90° G. Fold Bottom panel (7) 180° around (8) H. Slot (3) into (4) I. Repeat A to H for Top panel J. Fold (9) 90° on both sides K. Fold (10) 90° L. Fold (12) 90° till Top panel sits over the top of Bottom panel and (33)+(23) are sitting on the outside walls of (14)+(18).

FIG. 7A

A. Fold (6) 90° B. Fold (7) 180° C. Slot (3) into (4) D. Fold (5) 90° on both sides. E. Fold (10) 90° F. Fold (9) 90° on both sides G. Fold (1) 90° H. Fold (2) 180° around (8)+(25) I. Slot (3) into (4) J. Repeat G to I on the opposite side K. Fold (11) 90° L. Fold (12) 90° till (13) is slotted within the inner wall of (14).

FIG. 7B

A. Fold (6) 90° B. Fold (7) 180° C. Slot (3) into (4) D. Fold (5) 90° on both sides E. Fold (10) 90° F. Fold (9) 90° on both sides G. Fold (1) 90° H. Fold (2) 180° around (8)+(25) I. Slot (3) into (4) J. Repeat G to I on the opposite side K. Fold Top panel (1) 90° on both sides L. Fold (11) 90° M. Fold (12) 90° and slot (13)+(23) within the inner walls of (14)+(18).

FIG. 7C

A. Fold Bottom panel (1) 90° B. Fold Bottom panel (2) 180° C. Slot (3) into (4) D. Fold (5) 90° E. Repeat A to D on the opposite side F. Fold (6) 90° G. Fold (7) 180° around (8) H. Slot (3) into (4) I. Fold Top panel (1) 90° on both sides J. Fold (9) 90° on both sides K. Fold (10) 90° L. Fold (12) 90° till (23) are slotted within the inner walls of (18).

FIG. 7D

A. Fold Bottom panel (1) 90° B. Fold Bottom panel (2) 180° C. Slot (3) into (4) D. Fold (5) 90° E. Repeat A to D on the opposite side F. Fold (6) 90° G. Fold (7) 180° around (8) H. Slot (3) into (4) I. Fold Top panel (1) 90° on both sides J. Fold (11) 90° K. Fold (9) 90° on both sides L. Fold (10) 90° M. Fold (12) 90° till (13)+(23) are slotted within the inner walls of (14)+(18).

FIG. 7E

A. Fold (1) 90° B. Fold (2) 180° C. Slot (3) into (4) D. Fold (5) 90° E. Repeat A to D on the opposite side F. Fold (6) 90° G. Fold (7) 180° around (8) H. Slot (3) into (4) I. Fold (9) 90° on both sides J. Fold (10) 90° K. Fold (11) 90° L. Fold (12) 90° till (13) is slotted within the inner wall of (14).

FIG. 7F

A. Fold Bottom panel (1) 90° B. Fold Bottom panel (5) 90° C. Repeat A and B on the opposite side D. Fold (6) 90° E. Fold (7) 180° around (8) F. Slot (3) into (4) G. Repeat A to F for the Top panel H. Fold (9) 90° I. Fold (10) 90° J. Fold (12) 90° till Top panel sits over the outer walls of (14)+(18).

FIG. 7G

A. Fold Bottom panel (1) 90° B. Fold (5) 90° C. Repeat A and B on the opposite side D. Fold (6) 90° E. Fold (7) 180° around (8) F. Slot (3) into (4). G. Fold Top panel (1) 90° on both sides H. Fold (11) 90° I. Fold (9) 90° on both sides J. Fold (10) 90° K. Fold (12) 90° slot (13)+(23) within the inner walls of (14)+(18).

FIG. 7H

A. Fold (6) 90° B. Fold (7) 180° C. Slot (3) into (4) D. Fold (5) 90° on both sides. E. Fold (10) 90° F. Fold (9) 90° on both sides G. Fold (1) 90° H. Fold (2) 180° around (8)+(25) I. Slot (3) into (4) J. Repeat G to I on the opposite side K. Fold (28) 90° L. Fold (26) and (27) 90° M. Fold (29) 90° N. Fold (11) 90° O. Fold (12) 90° till (30) are inside the inner walls of (18) and also (13) is in the inner wall of (14) P. Slot (31) into (32).

FIG. 8A

A. Fold (6) 90° B. Fold (38) Reverse 90° C. Fold (7) Reverse 180° D. Slot (19) into (20) E. Fold (10) 90° F. Fold (5) 90° G.

Fold (9) 90° H. Fold Bottom panel (1) 90° I. Fold Bottom panel (2) 180° around (8)+(25) J. Slot (3) into (4) K. Repeat F to J on the opposite side L. Fold (1) 90° on both sides M. Fold (11) 90° N. Fold (12) 90° till (13)+(23) are slotted within the inner walls of (14)+(18).

FIG. 8B

A. Fold (6) 90° B. Fold (38) Reverse 90° C. Fold (7) Reverse 180° D. Slot (19) into (20) E. Fold Bottom panel (5) 90° F. Fold Bottom panel (1) 90° G. Fold Bottom panel (2) 180° around (8) H. Slot (3) into (4) I. Repeat F to H on the opposite side J. Fold Top panel (1) 90° on both sides K. Fold (11) 90° L. Fold (21) 90° on both sides M. Fold (9) 90° on both sides N. Fold (10) 90° O. Fold (12) 90° till (22) is slotted into the opening of (18) on both sides and to place (23) on the inside of the bottom panel (18).

FIG. 8C

A. Fold Bottom panel (6) 90° B. Fold (38) Reverse 90° C. Fold Bottom panel (7) Reverse 180° D. Slot (19) into (20) E. Fold Bottom panel (5) 90° F. Fold Bottom panel (1) 90° G. Fold Bottom panel (2) 180° around (8) H. Slot (3) into (4) I. Repeat E to H on the opposite side J. Fold Top panel (1) 90° on both sides K. Fold Top panel (5) 90° on both sides L. Fold Top panel (6) 90° M. Fold Top panel (7) 180° around (8) N. Fold (9) 90° on both sides O. Fold (10) 90° P. Fold (12) 90° till (23)+(33) are within the inner walls of (14)+(18).

FIG. 9A

A. Fold Bottom panel (6) 90° B. Fold (26) Reverse 90° C. Fold (7) Reverse 180° D. Slot (19A) into (20A) E. Fold (5) 90° F. Fold Bottom panel (1) 90° G. Fold (2) 180° around (8) H. Slot (3) into (4) I. Repeat E to H on the opposite side J. Fold Top panel (1) 90° K. Fold Top panel (5) 90° L. Repeat K and L on the opposite side M. Fold Top panel (6) 90° N. Fold Top panel (7) 180° around (8) O. Fold (9) 90° on both sides P. Fold (10) 90° Q. Fold (12) 90° till Top panel is sitting inside the inner walls of (18)+(27).

FIG. 9B

A. Fold (6) 90° B. Fold (26) Reverse 90° C. Fold (7) Reverse 180° D. Slot (19A) into (20A) E. Fold (5) 90° F. Fold Bottom panel (1) 90° G. Fold (2) 180° around (8) H. Slot (3) into (4) I. Repeat E to H to the opposite side J. Fold (9) 90° on both sides K. Fold Top panel (1) 90° L. Fold (11) 90° M. Fold (21) 90° N. Fold (10) 90° O. Fold (12) 90° until (22) is slotted into the opening of (18) on both sides and to place (23) on the inner walls of the Bottom panel (18).

FIG. 10A

A. Fold (1) 90° B. Fold (5) 90° C. Repeat A and B on the opposite side D. Fold (6) 90° E. Fold (7) 180° around (8) F. Slot (3) into (4) G. Fold (9) 90° on both sides H. Fold (10) 90° I. Fold (12) 90° J. Fold (15) 90° upwards K. Fold (16) 90° downwards to form an L shape for (17) L. Repeat K to all sides so L shape will be against outer walls of (14)+(18).

FIG. 10B

A. Fold Bottom panel (1) 90° on both sides B. Fold Bottom panel (5) 90° on both sides C. Fold Bottom panel (6) 90° D. Fold Bottom panel (7) 180° around (8) E. Slot (3) into (4) F. Fold (16) 90° on both sides G. Fold Top panel (5) 90° on both sides H. Fold Top panel (6) 90° I. Fold Top panel (7) 180° around (8) J. Slot (3) into (4) K. Fold (15) Reverse 90° into an L shape on both sides L. Fold (9) 90° on both sides M. Fold (10) 90° N. Fold (12) 90° till the Top panel is sitting on the Bottom panel and the Top panel (14)+(17) is on the outer walls of Bottom panel (14)+(18).

FIG. 10C

A. Fold Bottom panel (1) 90° on both sides B. Fold Bottom panel (5) 90° on both sides C. Fold Bottom panel (6) 90° D. Fold Bottom panel (7) 180° around (8) E. Slot (3) into (4) F. Fold (16) 90° on both sides G. Fold Top panel (5) 90° on both sides H. Fold Top panel (6) 90° I. Fold Top panel (7) 180° around (8) J. Slot (3) into (4) K. Fold (15) Reverse 90° into an L shape on both sides L. Fold (9) 90° on both sides M. Fold (10) 90° N. Fold (12) 90° till the Top panel is sitting on the Bottom panel and the Top panel (33) is on the outer walls of Bottom panel (14).

FIG. 10D

A. Fold Bottom panel (6) 90°. B. Fold (16) 90° C. Fold Bottom panel (5) 90° D. Fold (15) Reverse 90° to form an L shape E. Repeat B to D on the opposite side F. Fold (26) Reverse 90° G. Fold Bottom panel (7) Reverse 180° around (8) H. Slot (19A) into (20A) I. Fold (1) 90° on both sides J. Fold Top panel (5) 90° on both sides K. Fold Top panel (6) 90° L. Fold Top panel (7) 180° around (8) M. Slot (3) into (4) N. Fold (9) 90° on both sides O. Fold (10) 90° P. Fold (12) 90° till Top panel is sitting within the Bottom panel.

FIG. 11A

A. Fold Bottom Panel (1) 90° on both sides B. Fold Bottom panel (5) 90° on both sides C. Fold Bottom panel (6) 90° D. Fold Bottom panel (7) 180° around (8) E. Slot (3) into (4) F. Fold Top panel (1) 90° on both sides G. Fold Top panel (2) 180° on both sides H. Slot (3) into (4) I. Fold Top panel (5) 90° on both sides J. Fold Top panel (6) 90° K. Fold Top panel (7) 180° around (8) L. Slot (3) into (4) M. Fold (9) 90° on both sides N. Fold (10) 90° O. Fold (12) 90° till Top panel sits over the outer walls of (14)+(18).

FIG. 11B

A. Fold Bottom panel (1) 90° B. Fold (5) 90° C. Repeat A and B on the opposite side D. Fold (6) 90° E. Fold (7) 180° around (8) F. Slot (3) into (4) G. Fold Top panel (1) 90° on both sides H. Fold (11) 90° I. Fold (9) 90° on both sides J. Fold (10) 90° K. Fold (12) 90° slot (13) within the inner walls of (14).

FIG. 12

A. Fold Bottom Panel (1) 90° on both sides B. Fold Bottom panel (5) 90° on both sides C. Fold Bottom panel (6) 90° D. Fold Bottom panel (7) 180° around (8) E. Slot (3) into (4) F. Fold Top panel (1) 90° on both sides G. Fold Top panel (2) 180° on both sides H. Slot (3) into (4) I. Fold Top panel (5) 90° on both sides J. Fold Top panel (6) 90° K. Fold Top panel (7) 180° around (8) L. Slot (3) into (4) M. Fold (9) 90° on both sides N. Fold (10) 90° O. Fold (12) 90° till Top panel sits over the outer walls of (14)+(18).

FIG. 1R

A. Fold Bottom panel (1) 90° B. Fold Bottom panel (2) 180° C. Slot (3) into (4) D. Fold (34) 90° E. Fold (35) Reverse 90° F. Fold Bottom panel (5) 90° G. Repeat A to F on the opposite side H. Fold Bottom panel (6) 90° I. Fold Bottom panel (7) 180° around (8) J. Slot (3) into (4) K. Fold Top panel (1) 90° L. Fold Top panel (2) 180° M. Slot (3) into (4) N. Fold Top panel (5) 90° O. Repeat K to N on the opposite side P. Repeat H to J for the Top panel Q. Fold (9) 90° on both sides R. Fold (10) 90° S. Fold (12) 90° till the Top panel is sitting over the Bottom panel.

FIG. 2R

A. Fold Bottom panel (1) 90° B. Fold Bottom panel (2) 180° C. Slot (3) into (4) D. Fold (34) 90° E. Fold (35) Reverse 90° F. Fold Bottom panel (5) 90° G. Repeat A to F on the opposite side H. Fold Bottom panel (6) 90° I. Fold Bottom panel (7) 180° around (8) J. Slot (3) into (4) K. Fold Top panel (1) 90° L. Fold Top panel (5) 90° M. Repeat K to L on the opposite side N. Repeat H to J for the Top panel O. Fold (9) 90° on both sides P. Fold (10) 90° Q. Fold (12) 90° till the Top panel is sitting over the Bottom panel.

FIG. 3R

A. Fold Bottom panel (1) 90° B. Fold Bottom panel (2) 180° C. Slot (3) into (4) D. Fold (34) 90° E. Fold (35) Reverse 90° F. Fold Bottom panel (5) 90° G. Repeat A to F on the opposite side H. Fold Bottom panel (6) 90° I. Fold Bottom panel (7) 180° around (8) J. Slot (3) into (4) K. Fold Top panel (6) 90° L. Fold Top panel (5) 90° on both sides M. Fold Top panel (1) 90° N. Fold Top panel (2) 180° around (8) O. Slot (3) into (4) P. Repeat M to O to the opposite side Q. Fold (9) 90° on both sides R. Fold (10) 90° S. Fold (12) 90° till the Top panel is sitting over the Bottom panel.

FIG. 4R

A. Fold Bottom panel (1) 90° B. Fold Bottom panel (2) 180° C. Slot (3) into (4) D. Fold (34) 90° E. Fold (35) Reverse 90° F. Fold Bottom panel (5) 90° G. Repeat A to F on the opposite side H. Fold Bottom panel (6) 90° I. Fold Bottom panel (7) 180° around (8) J. Slot (3) into (4) K. Fold Top panel (1) 90° on both sides L. Fold (11) 90° M. Fold (9) 90° on both sides N. Fold (10) 90° O. Fold (12) 90° till (13)+(23) are sitting inside the Bottom panel walls of (14)+(18).

FIG. 5R

A. Fold (10) 90° B. Fold (9) 90° C. Fold Bottom panel (1) 90° D. Fold (34) Reverse 90° E. Fold Bottom panel (2) 180° around (25) F. Slot (3) into (4) G. Fold (35) Reverse 90° H. Fold Bottom panel (5) 90° I. Repeat B to H on the opposite side J. Fold Bottom panel (6) 90° K. Fold Bottom panel (7) 180° around (8) L. Slot (3) into (4) M. Fold (11) 90° N. Fold (12) 90° till (13) is in the inner wall of (14).

What is claimed is:

1. A container comprising:

a main panel having a plurality of substantially straight edges about its periphery, each edge extending angularly from each of two adjoining edges;

a plurality of side walls depending from at least half of the edges of said main panel, said edges having side walls hereinafter referred to as remaining edges, said side walls enclosing a space;

one or more of said side walls having an outer wall panel and an inner wall panel, said outer wall panel extending from a proximal fold or score line along a remaining edge and said inner wall panel extending from a distal fold or score line remote from the proximal fold or score line and along an opposed edge of said outer wall panel, the combination of panels forming a roll-over wall;

one or more of said roll-over walls further include a plurality of removable portions operatively removable from the outer wall panel;

wherein removal of the removable portions from the outer wall panel leaves the remainder of the outer wall panel and the entire inner wall panel to provide structural integrity of the container even after the removable portions have been removed, the outer wall panel of at least one removable portion is provided with markings indicating an advertising promotion, offer, coupon or token for a reward preferably subject to predetermined conditions being met; and wherein at least one bottom tab is formed on the outer wall panel and positioned at a lower surface or edge of the container and provides supports to elevate the assembled container off a surface thereby allowing for air to circulate thereunder, and at least one top tab is formed on the outer wall panel and positioned at an upper surface or edge of the container opposite the at least one bottom tab.

2. A container according to claim 1, wherein the removable portion or portions comprise a perforation line or line of weakness to facilitate removal of the at least one removable portion from the remaining wall portion, the remaining outer wall portion together with the inner wall panel, which is left intact after removal of the at least one removable portion, retain such sufficient structural integrity that the container remains stackable and is able to retain at least one of the heat or freshness of its contents enclosed therein.

3. A container according to claim 1, wherein at least one of the at least one removable portion or the remaining wall portion includes a slit or slot providing for at least one tab to facilitate easy removal of the removable portion from the outer wall panel.

4. A container according to claim 1, wherein the sidewalls are at equal angles to each adjoining sidewall and the side walls have substantially parallel edges such that the main panels are close to a substantially parallel spaced apart disposition, there being three side walls which together with the joining panel constitute a four-sided carton forming a square or rectangular prism and the side walls and joining panel have dimensions selected for the packaging of pizza style pies, and further comprises at least one of: ventilation holes, corner reinforcing tabs, or simple single-paneled side walls on the main panel not having the roll-over walls.

5. A container according to claim 1, wherein the at least one removable portion is provided with magnetic material to permit the removable portion to be temporarily attached to a metallic surface.

6. A container according to claim 1, wherein at least one of the plurality of removable portions includes the at least one bottom tab and the at least one top tab that are formed on the outer wall panel.

7. A blank for a carton comprising:

two main panels, each main panel being substantially the same shape and having a plurality of substantially straight edges or fold or score lines about its periphery, each edge, fold or score line extending angularly to each of two adjoining edges or fold or score lines, and said main panels being joined to one another by a joining panel having substantially parallel edges each of which constitutes a hinge line in common with one of the fold or score lines of each main panel;

a plurality of side panel assemblies extending from the remaining fold or score lines about said main panels such that at least half of the periphery of both main panels is constituted by a fold or score line from which said side panels extend;

wherein at least one of said side panel assemblies includes an outer wall panel and an inner wall panel, said outer wall panel extending from a proximal fold or score line in common with the fold or score line at the periphery of the adjoining main panel and said inner wall panel extending from a distal fold or score line remote from the proximal fold or score line; and wherein at least one of said side panel assemblies further includes at least one line of weakness circumscribing at least one removable portion from the outer wall panel, the remainder of the outer wall panel and the entire inner wall panel being sufficient to provide structural integrity of the container when assembled from the blank, substantially unaffected after the removal of any one or more of said at least one removable portion, an outer wall panel of the at least one removable portion is provided with markings indicating an advertising promotion, offer, coupon or token for a reward preferably subject to predetermined conditions being met; and wherein at least one bottom tab is formed on the outer wall panel and positioned at a lower surface or edge of the container and provides supports to elevate the assembled container off a surface thereby allowing for air to circulate thereunder, and at least one top tab is formed on the outer wall panel and positioned at an upper surface or edge of the container opposite the at least one bottom tab.

8. A container according to claim 7, wherein the at least one removable portion includes the at least one bottom tab and the at least one top tab that are formed on the outer wall panel.

9. A container comprising:

two main panels, each substantially the same shape and having a plurality of substantially straight edges about its periphery, each edge extending angularly from each of two adjoining edges, and said main panels being joined to one another by a joining panel having substantially parallel edges each of which constitutes a hinge line along one of the edges of each said main panel;

a plurality of side walls depending from at least half of the edges of said main panels other than those having a common edge with the hinge line, said edges having side walls hereinafter referred to as remaining edges, said side walls and said joining panel enclosing a space between said main panels when said main panels are pivoted towards one another to define the enclosed space;

wherein at least one of said side walls includes an outer wall panel and an inner wall panel, said outer wall panel extending from a proximal fold or score line along a remaining edge and said inner wall panel extending from a distal fold or score line remote from the proximal fold or score line and along an opposed edge of said outer wall panel, the combination of panels forming a roll-over wall; and wherein one or more of said roll-over walls further include at least one removable portion operatively removable from to leave a remaining wall portion such that the remainder of the outer wall panel and the entire inner wall panel to provide structural integrity of the container even after the removable portions have been removed, the outer wall panel of at least one removable portion is provided with markings indicating an advertising promotion, offer, coupon or token for a reward preferably subject to predetermined conditions being met; and wherein at least one bottom tab is formed on the outer wall panel and positioned at a lower surface or edge of the container and provides supports to elevate the assembled container off a surface thereby allowing for air to circulate thereunder, and at least one top tab is formed on the outer wall panel and positioned at an upper surface or edge of the container opposite the at least one bottom tab.

10. A container according to claim 9, wherein one of the main panels constitutes a base panel and the other a cover panel and all of the remaining sidewalls of one of the main panels is provided with sidewalls in which the at least one removable portion comprises a portion of the outer wall panel and wherein removal of the at least one removable portion from the remainder of the outer wall panel leaves the remainder of the outer wall panel and the entire inner wall panel to provide structural integrity of the container once the one or more of the at least one removable portion has been removed.

11. A container according to claim 9, wherein the at least one removable portion is arranged with a perforation line or line of weakness to facilitate removal from the remaining wall portion and inner wall panel and the remaining outer wall portion together with the inner wall panel, which is left intact after removal of the removable portion, retain sufficient structural integrity that the container remains stackable and is able to retain at least one of the heat or freshness of its contents enclosed therein.

12. A container according to claim 9, wherein at least one of the at least one removable portion or the remaining wall portion include a slit or slot providing for a tab to facilitate removal of the at least one removable portion from the outer wall panel.

13. A container according to claim 9, in which the sidewalls are at equal angles to each adjoining sidewall and the side walls have substantially parallel edges such that the main panels are spaced apart substantially parallel, there being three side walls which together with the joining panel constitute a four-sided carton forming a square or rectangular prism and the side walls and joining panel have dimensions selected for the packaging of pizza style pies, and further comprises at least one of: ventilation holes, corner reinforcing tabs, or simple single-paneled side walls on the main panel not having the roll-over walls.

14. A container according to claim 9, the at least one removable portion is provided with magnetic material to permit the removable portion to be temporarily attached to a metallic surface.

15. A container according to claim 9, wherein the at least one removable portion includes the at least one bottom tab and the at least one top tab that are formed on the outer wall panel.

* * * * *